US005120636A

United States Patent [19]

Takahashi et al.

[11] Patent Number: 5,120,636

[45] Date of Patent: Jun. 9, 1992

[54] SILVER HALIDE COLOR PHOTOGRAPHIC MATERIAL CONTAINING MAGENTA COUPLER, SPECIFIC ORGANIC SOLVENT AND BISPHENOL COMPOUND

[75] Inventors: Osamu Takahashi; Hideaki Naruse, both of Kanagawa, Japan

[73] Assignee: Fuji Photo Film Co., Ltd., Kanagawa, Japan

[21] Appl. No.: 528,998

[22] Filed: May 25, 1990

[30] Foreign Application Priority Data

May 25, 1989 [JP] Japan ..... 1-131767

[51] Int. Cl.[5] ..... G03C 1/34; G03C 1/38; G03C 7/38

[52] U.S. Cl. ..... 430/546; 430/551; 430/558; 430/567; 430/548

[58] Field of Search ..... 430/558, 551, 546, 567, 430/548

[56] References Cited

U.S. PATENT DOCUMENTS

| | | | |
|---|---|---|---|
| H122 | 9/1986 | Kawagishi et al. . | |
| 3,700,455 | 10/1972 | Ishikawa et al. | 430/554 |
| 4,639,413 | 1/1987 | Kawagishi et al. | 430/546 |
| 4,762,773 | 8/1988 | Takahashi et al. | 430/380 |
| 4,865,963 | 9/1989 | Furutachi et al. | 430/558 |
| 4,906,559 | 3/1990 | Nishijima et al. | 430/551 |

FOREIGN PATENT DOCUMENTS

| | | |
|---|---|---|
| 0280238 | 8/1988 | European Pat. Off. . |
| 0309158 | 3/1989 | European Pat. Off. . |
| 0309159 | 3/1989 | European Pat. Off. . |
| 0309160 | 3/1989 | European Pat. Off. . |
| 0355660 | 2/1990 | European Pat. Off. . |
| 62-81639 | 4/1987 | Japan . |
| 62-85247 | 4/1987 | Japan . |
| 62-98352 | 5/1987 | Japan . |
| 62-215272 | 9/1987 | Japan . |
| 1529908 | 10/1978 | United Kingdom . |

OTHER PUBLICATIONS

2244 Research Disclosure, No. 158, pp. 45 to 47 (June, 1977) "High boiling organic solvents for dispersion of photographic additives"

*Primary Examiner*—Lee C. Wright

*Attorney, Agent, or Firm*—Sughrue, Mion, Zinn, Macpeak & Seas

[57] ABSTRACT

A silver halide color photographic material comprising a support having thereon at least one silver halide emulsion layer, wherein at least one of the silver halide emulsion layers contains at least one magenta coupler represented by the general formula (I) described below, at least one organic solvent having a high boiling point which has at least one bond in its molecule, wherein $R_{13}$ represents an alkyl group, an aryl group, an alkoxy group, an aryloxy group, an alkylthio group or an arylthio group, and at least one compound represented by the general formula (II) described below:

(I)

wherein Za and Zb each represents or =N—; $R_1$ and $R_2$ each represents a hydrogen atom or a substituent; X represents a hydrogen atom or a group capable of being released upon a coupling reaction with an oxidation product of an aromatic primary amine developing agent; when the Za-Zb bond is a carbon-carbon double bond, it may form a part of a condensed aromatic; and $R_1$, $R_2$ or X may form a polymer including a dimer or a higher polymer, (II)

wherein $R_3$, $R_4$, $R_5$ and $R_6$ each represents and alkyl group having from 1 to 18 carbon atoms; $R_7$ represents a hydrogen atom or an alkyl group having from 1 to 12 carbon atoms; and n represents an integer of 1 to 3, with the proviso that when n is 2 or 3, two or three groups represented by $R_7$ may be the same or different, and when n is 1, the group represented by $R_7$ is the alkyl group defined above.

22 Claims, No Drawings

SILVER HALIDE COLOR PHOTOGRAPHIC MATERIAL CONTAINING MAGENTA COUPLER, SPECIFIC ORGANIC SOLVENT AND BISPHENOL COMPOUND

FIELD OF THE INVENTION

The present invention relates to a silver halide photographic material, and more particularly to a silver halide color photographic material in which color reproducibility is improved and discoloration and/or fading of a dye image due to light is restrained.

BACKGROUND OF THE INVENTION

Among silver halide color photographic materials, those containing three kinds of color couplers which form yellow, magenta and cyan colors upon coupling with an oxidation product of an aromatic primary amine color developing agent, respectively are most conventional.

As the magenta coupler employed therein, pyrazolotriazole magenta couplers, for example, those as described in U.S. Pat. No. 3,725,067 are preferred from the standpoint of color reproduction because they form azomethine dyes which have a less undesirable subsidiary absorption in the region around 430 nm. Also, they are preferred since the occurrence of yellow stain in uncolored portions owing to heat and humidity is restrained.

However, these couplers have a problem in that the azomethine dyes formed therefrom have only low fastness to light.

In order to improve light-fastness of the pyrazoloazole type magenta couplers described above, various techniques has been proposed. For example, it is known to employ spiroindane type compounds as described, for example, in JP-A-59-118414 (the term "JP-A" as used herein means an "unexamined published Japanese patent application"), phenol or phenol ester type compounds as described, for example, in U.S. Pat. No. 4,588,679, JP-A-60-262159 corresponding to U.S. Pat. No. 4,735,893 and JP-A-61-282845, metal chelate compounds as described, for example, in JP-A-60-97353 corresponding to U.S. Pat. No. 4,590,153, silyl ether type compounds as described, for example, in JP-A-60-164743 corresponding to U.S. Pat. No. 4,559,297, and hydroxychroman type compounds as described, for example, in JP-A-61-177454. The light-fastness can be improved to some extent according to these techniques, but is still insufficient.

In accordance with hitherto known techniques including those described above, the effect for improving light-fastness of a dye image formed in areas of low density is small as compared to that in areas of high density, and as a result the color balance, particularly in the low density areas, of the three colors of yellow, magenta and cyan, of the remaining dye image, is changed. Thus, the effect for improvement is not satisfactory. Therefore, a technique for improving light-fastness of a dye image formed in the low density areas is desired.

SUMMARY OF THE INVENTION

An object of the present invention is to provide a silver halide color photographic material which is excellent in color reproducibility and provides a magenta color image having extremely improved light-fastness over a wide range from high density areas to low density areas.

Other objects of the present invention will become apparent from the following detailed description and examples.

These objects of the present invention can be accomplished by a silver halide color photographic material comprising a support having thereon at least one silver halide emulsion layer, wherein at least one of the silver halide emulsion layers contains at least one magenta coupler represented by the general formula (I) described below, at least one organic solvent having a high boiling point which has at least one

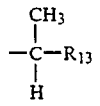

bond in its molecule wherein $R_{13}$ represents an alkyl group, an aryl group, an alkoxy group, an aryloxy group, an alkylthio group or an arylthio group, and at least one compound represented by the general formula (II) described below:

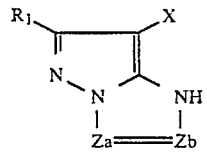

(I)

wherein Za and Zb each represents

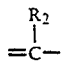

or =N—; $R_1$ and $R_2$ each represents a hydrogen atom or a substituent; X represents a hydrogen atom or a group capable of being released upon a coupling reaction with an oxidation product of an aromatic primary amine developing agent; when the Za-Zb bond is a carbon-carbon double bond, it may form a part of an aromatic ring; and $R_1$, $R_2$ or X may form a polymer including a dimer or a higher polymer,

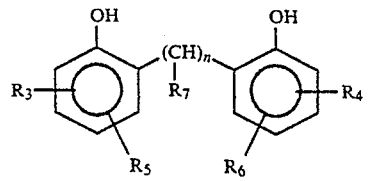

(II)

wherein $R_3$, $R_4$, $R_5$ and $R_6$ each represents an alkyl group having from 1 to 18 carbon atoms; $R_7$ represents a hydrogen atom or an alkyl group having from 1 to 12 carbon atoms; and n represents an integer of 1 to 3, with the proviso that when n is 2 or 3, the two or three groups represented by $R_7$ may be the same or different, and when n is 1, the group represented by $R_7$ is the alkyl group defined above.

DETAILED DESCRIPTION OF THE INVENTION

The magenta coupler represented by general formula (I) which can be used in the present invention is described in more detail below.

Of the pyrazoloazole magenta couplers represented by the general formula (I), those represented by general formula (Ia) or (Ib) described below are preferred.

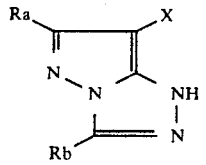

(Ia)

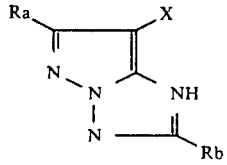

(Ib)

wherein Ra and Rb have the same meanings as defined for $R_1$ and $R_2$ in general formula (I) above, respectively; and X has the same meaning as defined in general formula (I) above.

In general formula (I), (Ia) or (Ib), $R_1$ or Ra and $R_2$ or Rb, which may be the same or different, each preferably represents a hydrogen atom, or a substituent which is a halogen atom, an alkyl group, an aryl group, a heterocyclic group, a cyano group, an alkoxy group, an aryloxy group, a heterocyclic oxy group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group or an aryloxycarbonyl group. Among them, an alkyl group, an alkoxy group, an alkylthio group, an aryl group, an aryloxy group, an arylthio group, an acylamino group and an anilino group are particularly preferred.

In general formula (I), (Ia) or (Ib), X preferably represents a hydrogen atom, a halogen atom, a carboxy group or a group capable of being released upon coupling which is bonded to the carbon atom at the coupling position of the magenta coupler through an oxygen atom, a nitrogen atom or a sulfur atom.

$R_1$ or Ra, $R_2$ or Rb, or X in general formula (I), (Ia) or (Ib) may be a divalent group to form a bis coupler. Further, the coupler represented by general formula (I), (Ia) or (Ib) may be in the form of a polymer coupler in which the coupler moiety exists at the main chain or the side chain of the polymer, and particularly a polymer coupler obtained from a vinyl monomer having the moiety of the coupler represented by general formula (I), (Ia) or (Ib) described above is preferred. In this case, $R_1$ or Ra, $R_2$ or Rb, or X represents a vinyl group or a linking group.

Specific examples of the linking group represented by $R_1$ or Ra, $R_2$ or Rb, or X in the cases wherein the moiety of the coupler represented by general formula (I), (Ia) or (Ib) is included in a vinyl monomer includes an alkylene group (including a substituted or unsubstituted alkylene group, e.g., methylene, ethylene, 1,10-decylene, or $-CH_2CH_2OCH_2CH_2-$), a phenylene group (including a substituted or unsubstituted phenylene group, e.g., 1,4-phenylene, 1,3-phenylene,

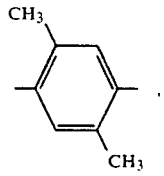

or

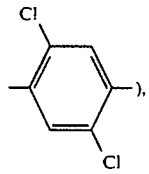

—NHCO—, —CONH—, —O—, —OCO—, and an aralkylene group (e.g.,

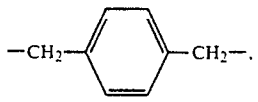

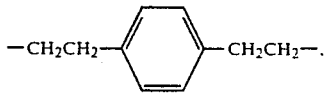

or

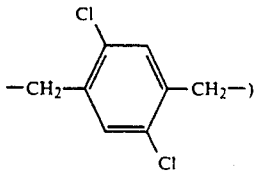

or a combination thereof.

Specific examples of preferred linking groups are set forth below.

—NHCO—, —$CH_2CH_2$—,

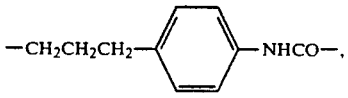

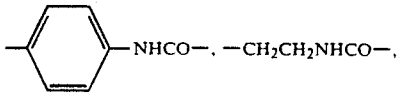

—$CH_2CH_2$—O—C(=O)—, —$CONHCH_2CH_2NHCO$—,

—$CH_2CH_2OCH_2CH_2NHCO$—,

-continued

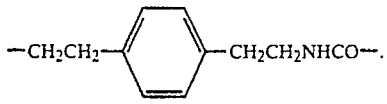

The magenta coupler represented by general formula (I) according to the present invention can be employed generally in an amount of from $1\times10^{-2}$ to 1 mol, preferably from $1\times10^{-1}$ to $5\times10^{-1}$ mol, per mol of silver halide.

Further, the magenta coupler according to the present invention can be employed together with one or more of other kinds of magenta couplers, if desired.

Typical examples of the magenta coupler represented by general formula (I) according to the present invention are specifically set forth below, but the present invention should not be construed as being limited thereto.

| Compound | Ra | Rb | X |
|---|---|---|---|
| | | 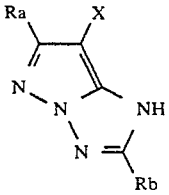 | |
| I-1 | $CH_3$— | 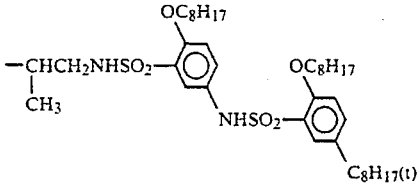 | Cl |
| I-2 | As above | 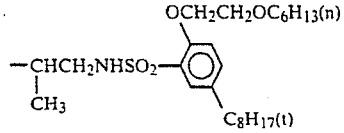 | As above |
| I-3 | $(CH_3)_3C$— | 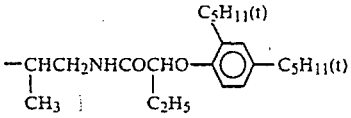 | 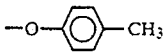 |
| I-4 | 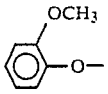 | 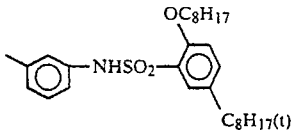 | 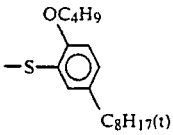 |
| I-5 | $CH_3$ | 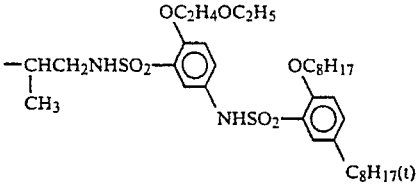 | Cl |
| I-6 | As above | 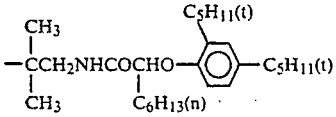 | As above |
| I-7 | $CH_3$— | 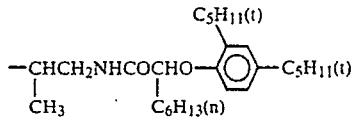 | Cl |

-continued
| Compound | Ra | Rb | X |
|---|---|---|---|
| I-8 | As above | 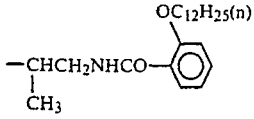 | As above |
| I-9 | As above | 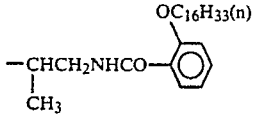 | As above |
| I-10 | 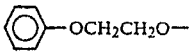 | 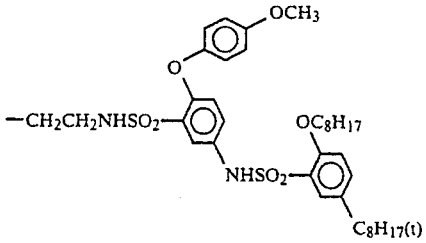 | 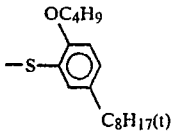 |
| I-11 | $CH_3CH_2O-$ | As above | As above |
| I-12 | 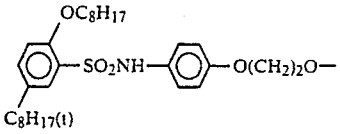 | 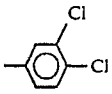 | 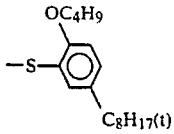 |
| I-13 | 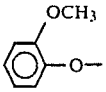 | 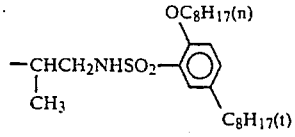 | Cl |
| | | 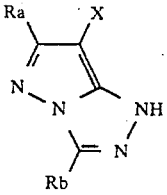 | |
| I-14 | $CH_3-$ | 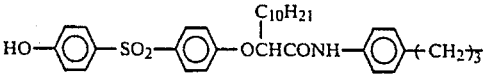 | Cl |
| I-15 | As above | 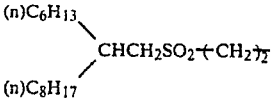 | As above |
| I-16 | 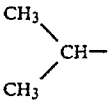 | 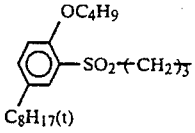 | As above |
| I-17 | 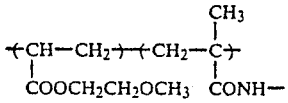 | 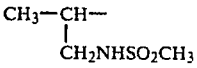 | As above |
| I-18 | 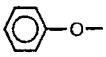 | 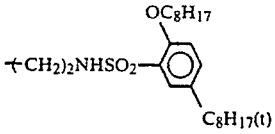 | Cl |

-continued

| Compound | Ra | Rb | X |
|---|---|---|---|
| I-19 | $CH_3$— | 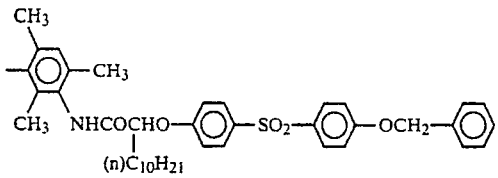 | As above |
| I-20 | $(CH_3)_3C$— | 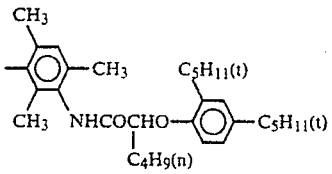 | As above |
| I-21 | 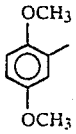 | 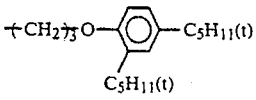 | Cl |
| I-22 | $CH_3$— | 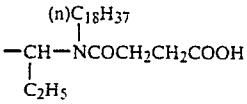 | As above |

Now, the organic solvent having a high boiling point which can be employed in the present invention is described in detail below.

Of the organic solvents having a high boiling point according to the present invention, those having a boiling point of 160° C. or above are preferred. Those which are solid at normal temperature may be used as far as they are sufficiently miscible with the coupler.

The organic solvent having a high boiling point according to the present invention can be employed individually or as a mixture of two or more thereof. Further, they may be employed together with organic solvents having a high boiling point other than those according to the present invention.

Examples of the organic solvent having a high boiling point containing the

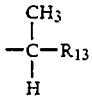

bond used in the present invention include those represented by the following general formula (III), (IV), (V), (VI), (VII), (VIII), (IX) or (X):

$$R_8—COOR_9 \quad (III)$$

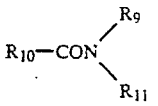

(IV)

-continued

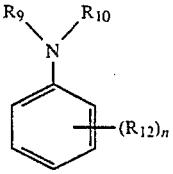

(V)

$$R_9—O—R_{10} \quad (VI)$$

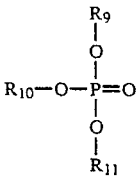

(VII)

$$R_9—SO_2NH—R_{10} \quad (VIII)$$

$$R_9—CONH—R_{10} \quad (IX)$$

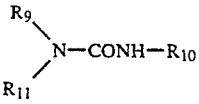

(X)

wherein $R_8$ represents a substituted or unsubstituted alkyl group, a substituted or unsubstituted cycloalkyl group, a substituted or unsubstituted alkenyl group or a substituted or unsubstituted heterocyclic group; $R_9$, $R_{10}$ and $R_{11}$ each represents a substituted or unsubstituted alkyl group, a substituted or unsubstituted cycloalkyl group, a substituted or unsubstituted alkenyl group, a substituted or unsubstituted aryl group or a substituted or unsubstituted heterocyclic group; $R_9$ and $R_{10}$ in general formula (VI) may combine with each other to form a ring; $R_{12}$ represents $R_9$, $—OR_9$ or $—SR_9$; and n represents an integer from 1 to 5, and when n is two or more, two or more $R_{12}$'s may be the same or different, with the proviso that the organic solvent having a high boiling point represented by the general formula (III), (IV), (V), (VI), (VII), (VIII), (IX) or (X) has at least one

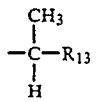

bond in the molecule thereof, at least one of $R_8$ and $R_9$ in general formula (III), at least one of $R_9$, $R_{10}$ and $R_{11}$ in the general formula (IV), (VII) or (X), at least one of $R_9$, $R_{10}$ and $R_{12}$ in the general formula (V), and at least one of $R_9$ and $R_{10}$ in the general formula (VI), (VIII) and (IX) has the

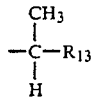

bond.

In the group of

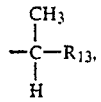

$R_{13}$ represents an alkyl group having 1 to 15 carbon atoms, an aryl group such as phenyl group, naphthyl group and a substituted group thereof, an alkoxy group having 1 to 15 carbon atoms, an aryloxy group such as phenoxy group, naphthoxy group and a substituted group thereof, an alkylthio group having 1 to 15 carbon atoms or an arylthio group such as phenylthio group, naphthylthio group and a substituted group therof. Of the groups represented by $R_{13}$, an alkyl group is preferred. The alkyl group represented by $R_{13}$ includes an alkyl group which may be unsubstituted or substituted by, for example, a halogen atom and a straight chain, branched chain or cyclic alkyl group.

Among the organic solvents having a high boiling point described above, these represented by general formula (IV) or (VII) are preferred, and those represented by general formula (VII) are particularly preferred.

It is preferred that at least one of $R_9$, $R_{10}$ and $R_{11}$ is an isopropyl-substituted phenyl group or

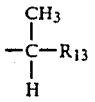

(wherein $R_{13}$ is an alkyl group having 1 to 15 carbon atoms).

Specific examples of the groups represented by $R_8$ to $R_{12}$ which do not contain the above described

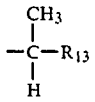

bond include those described in JP-A-62-92946, page 138, left upper column to page 144, right upper column.

The organic solvent having a high boiling point according to the present invention is employed in an amount from 0.2 to 5 times by weight, preferably from 1 to 4 times by weight based on the weight of the coupler to be used represented by general formula (I) according to the present invention.

Typical examples of the organic solvent having a high boiling point which are preferably employed in the present invention are specifically set forth below, but the present invention should not be construed as being limited thereto.

S-1

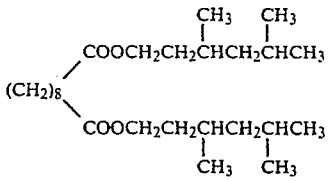

S-2

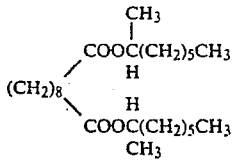

S-3

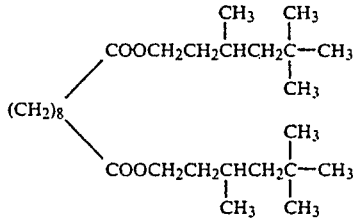

-continued
S-4
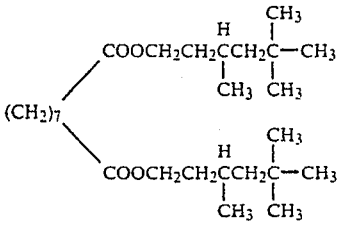
S-5
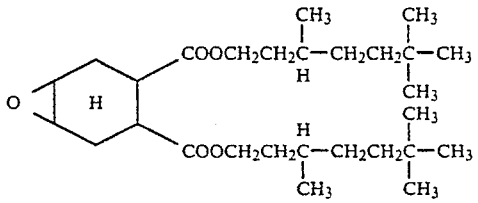
S-6
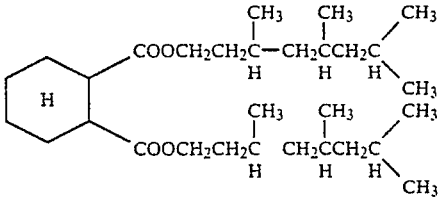
S-7
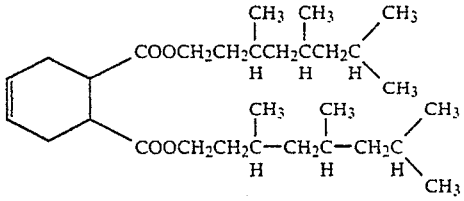
S-8
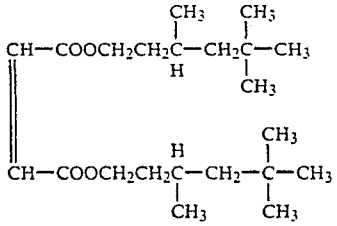
S-9
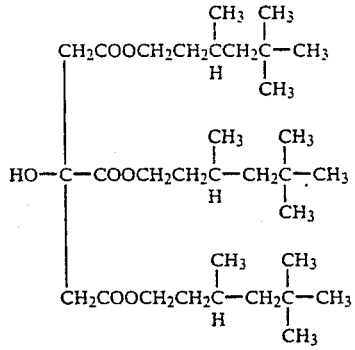
S-10
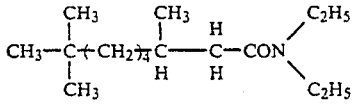
S-11
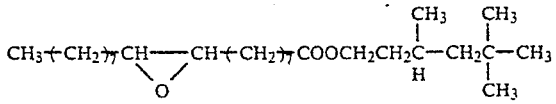

-continued
S-12
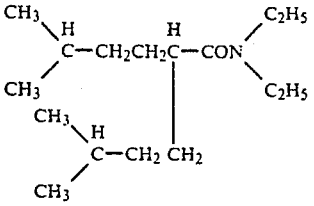
S-13
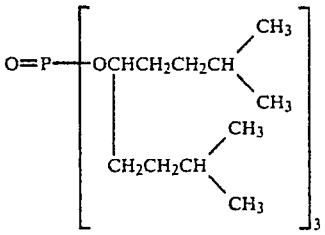
S-14
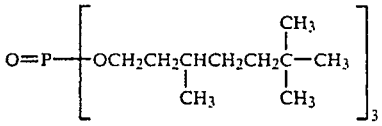
S-15
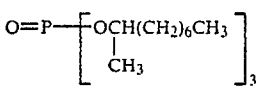
S-16
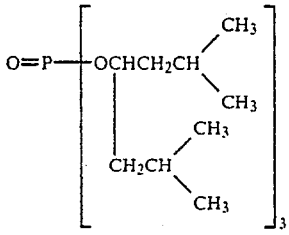
S-17
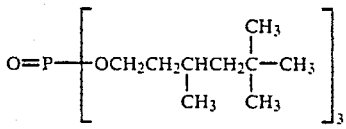
S-18
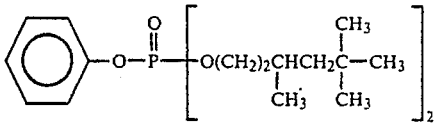
S-19
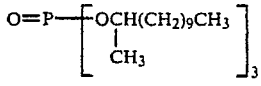
S-20
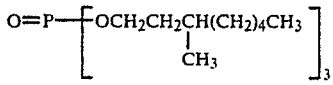
S-21
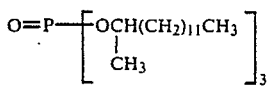

-continued
S-22
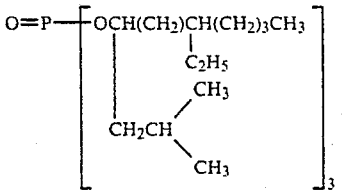
S-23
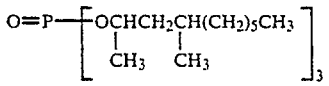
S-24
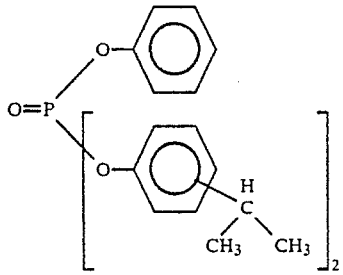
S-25
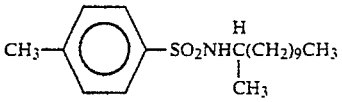
S-26
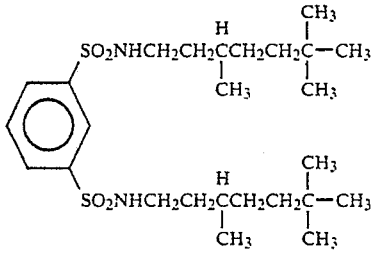
S-27
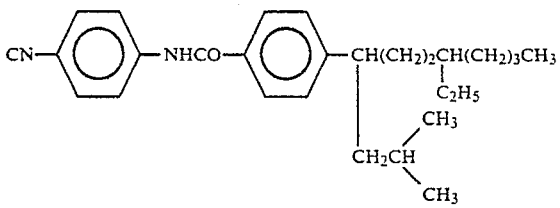
S-28
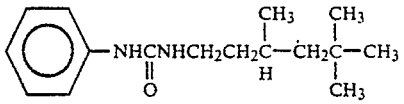
S-29
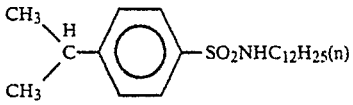
S-30
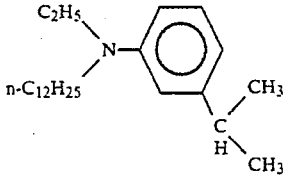

-continued

S-31

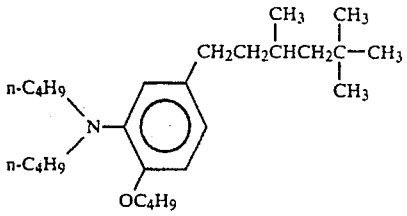

S-32

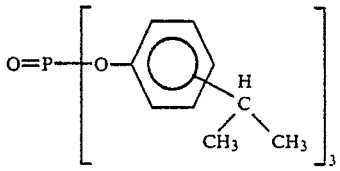

S-33

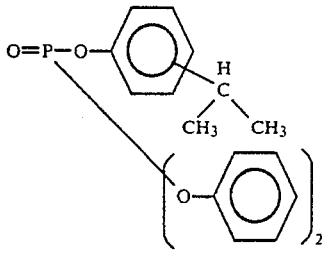

Now, the bisphenol compound represented by general formula (II) which can be employed in the present invention is described in detail below.

In general formula (II), the alkyl group represented by $R_3$, $R_4$, $R_5$, $R_6$ or $R_7$ includes a substituted or unsubstituted alkyl group and a straight chain, branched chain or cyclic alkyl group. Specific examples of the substituent for the substituted alkyl group include the substituents represented by $R_1$ or $R_2$ of the magenta coupler of formula (I) described hereinbefore. The total number of carbon atoms included in the groups represented by $R_3$ to $R_7$ is preferably from 6 to 32. $R_7$ is preferably an alkyl group having from 3 to 12 carbon atoms. In a more preferred case, both $R_3$ and $R_4$ each represents a methyl group.

The compound represented by general formula (II) according to the present invention is added in an amount of from 1 to 100 mole %, preferably from 1 to 30 mole %, based on the magenta coupler according to the present invention. The compound is preferably co-emulsified with the magenta coupler.

Specific examples of the compound represented by general formula (II) which can be employed in the present invention are set forth below, but the present invention should not be construed as being limited thereto.

(II-1)

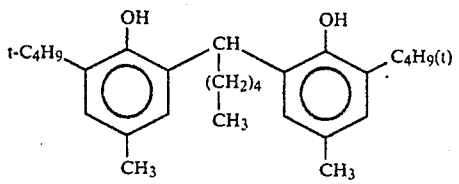

-continued (II-2)

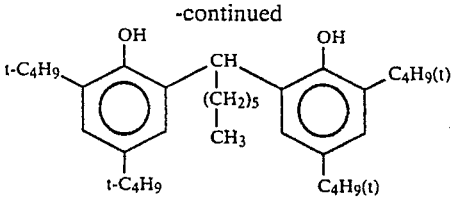

(II-3)

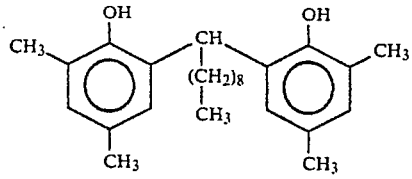

(II-4)

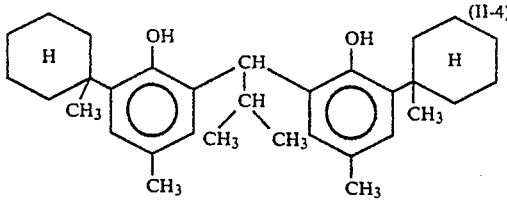

(II-5)

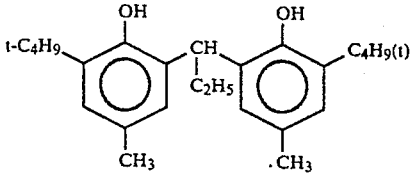

(II-6)

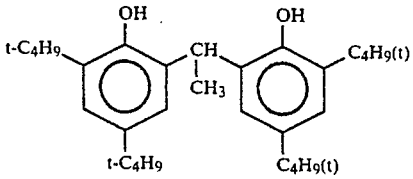

-continued

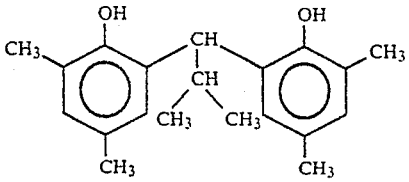
(II-7)

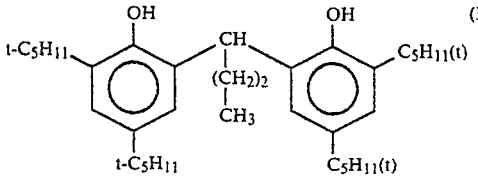
(II-8)

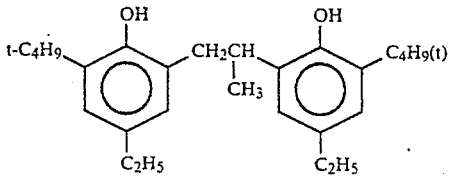
(II-9)

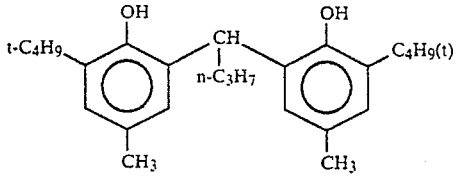
(II-10)

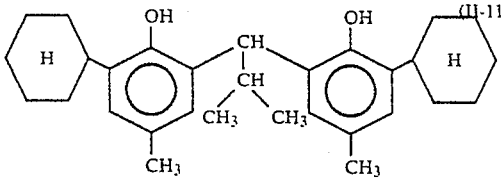
(II-11)

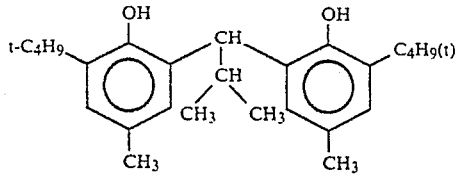
(II-12)

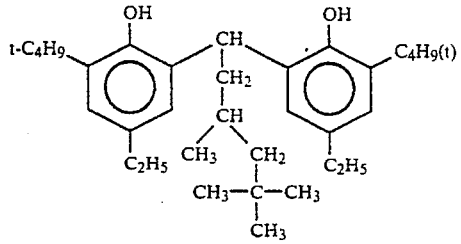
(II-13)

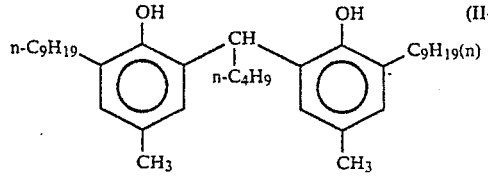
(II-14)

-continued

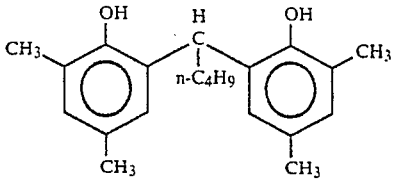
(II-15)

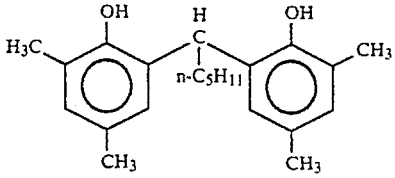
(II-16)

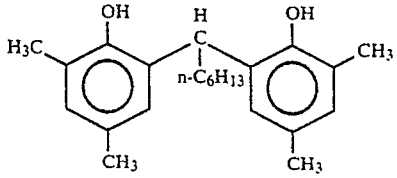
(II-17)

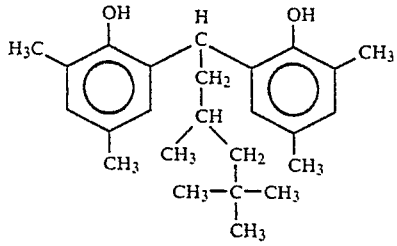
(II-18)

It is preferred that the magenta coupler represented by general formula (I) according to the present invention is dissolved in the organic solvent having a high boiling point containing the

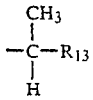

bond according to the present invention together with an auxiliary solvent (for example, an organic solvent having a low boiling point such as ethyl acetate), if desired, the resulting solution is emulsified and dispersed in an aqueous solution of gelatin with stirring, and the emulsified dispersion thus obtained is mixed with a silver halide emulsion to prepare a coating solution for the silver halide emulsion layer.

On the other hand, the bisphenol type compound represented by general formula (II) may be emulsified separately from the above described coupler using the organic solvent having a high boiling point according to the present invention or an organic solvent having a high boiling point without the scope of the present invention, but it is preferred to co-emulsify it together with the above described magenta coupler according to the present invention using the organic solvent having a high boiling point according to the present invention.

In the present invention, the bisphenol compound according to the present invention is preferably employed together with an image stabilizer which is represented by the following general formula (XI):

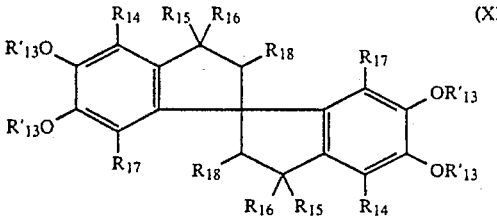

(XI)

wherein $R'_{13}$ represents an aliphatic group, an aromatic group, a heterocyclic group or a substituted silyl group represented by the formula

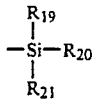

(wherein $R_{19}$, $R_{20}$ and $R_{21}$, which may be the same or different, each represents an aliphatic group, an aromatic group, an aliphatic oxy group or an aromatic oxy group); $R_{14}$, $R_{15}$, $R_{16}$, $R_{17}$ and $R_{18}$, which may be the same or different, each represents a hydrogen atom, an aliphatic group, an aromatic group, an acylamino group, a mono- or di-alkylamino group, an aliphatic or aromatic thio group, an aliphatic or aromatic oxycarbonyl group or —$OR'_{13}$.

Specific examples of the image stabilizer represented by general formula (XI) are set forth below, but the present invention should not be construed as being limited thereto.

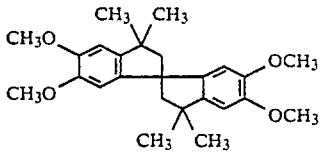

(XI-1)

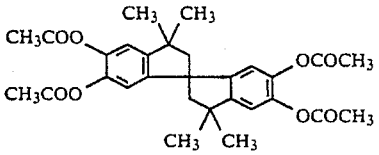

(XI-2)

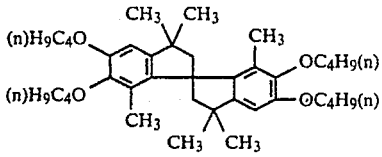

(XI-3)

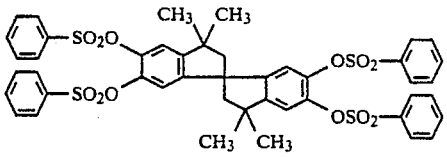

(XI-4)

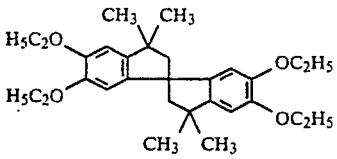

(XI-5)

-continued

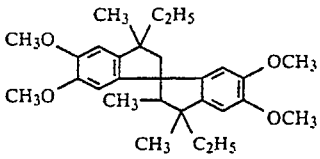

(XI-6)

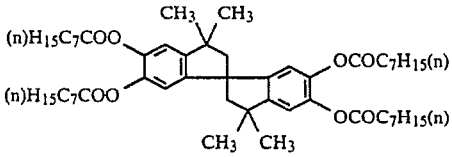

(XI-7)

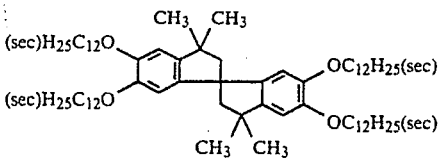

(XI-8)

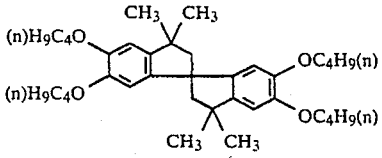

(XI-9)

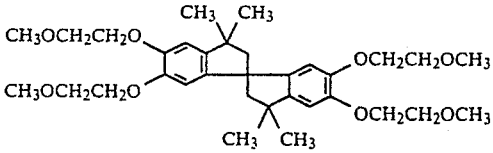

(XI-10)

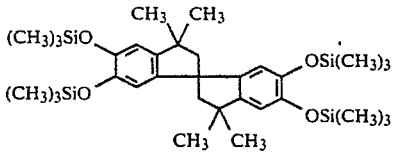

(XI-11)

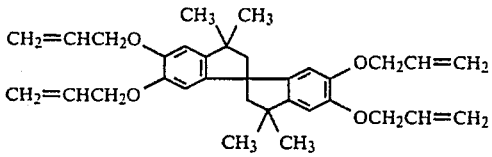

(XI-12)

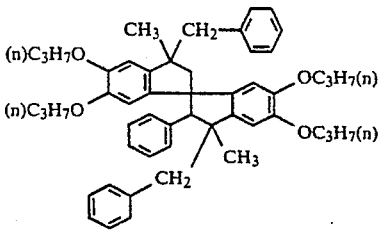

(XI-13)

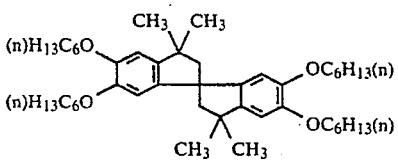

(XI-14)

-continued (XI-15)

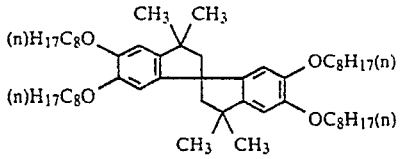

(XI-16)

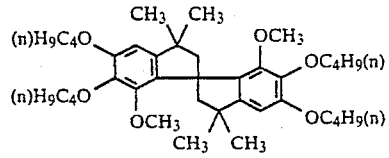

(XI-17)

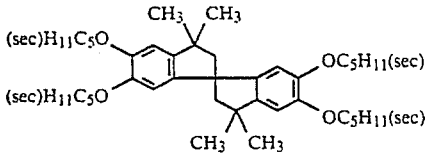

(XI-18)

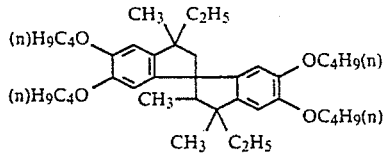

(XI-19)

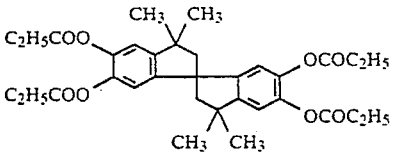

(XI-20)

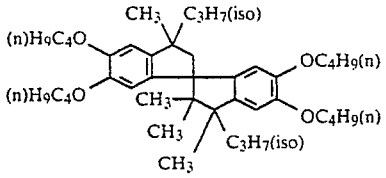

(XI-21)

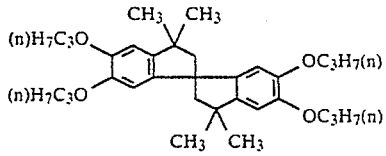

(XI-22)

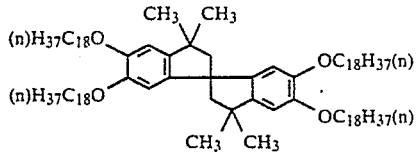

(XI-23)

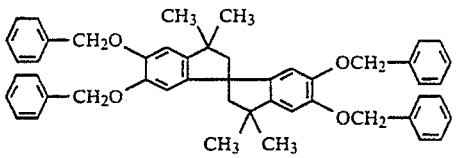

(XI-24)

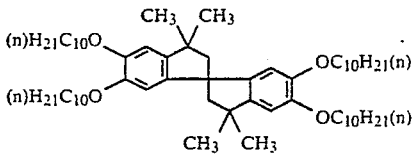

-continued (XI-25)

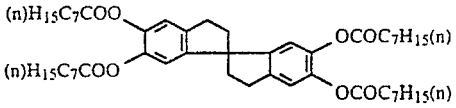

(XI-26)

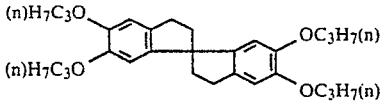

(XI-27)

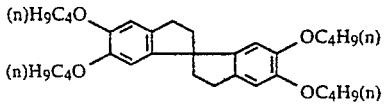

The image stabilizer represented by the general formula (XI) is preferably added in an amount of from 10 to 200 mole %, more preferably from 30 to 100 mole %, based on the magenta coupler represented by general formula (I).

The color photographic light-sensitive material according to the present invention may comprise a support having coated thereon at least one blue-sensitive silver halide emulsion layer, at least one green-sensitive silver halide emulsion layer and at least one red-sensitive silver halide emulsion layer. In case of conventional color printing paper, the light-sensitive layers are usually provided on a support in the order as described above, but they can be provided in a different order therefrom. Further, an infrared-sensitive silver halide emulsion layer may be employed in place of at least one of the above described emulsion layers. Each of the light-sensitive emulsion layers contains a silver halide emulsion having sensitivity in a respective wavelength region and a so-called color coupler which forms a dye of complementary color to the light to which the silver halide emulsion is sensitive, that is, yellow, magenta and cyan to blue, green and red, respectively. Thus, color reproduction by a subtractive process can be performed. However, the relationship of the light-sensitive layer and hue of dye formed from the coupler may be varied in a different way from that described above.

Silver halide emulsions used in the present invention are preferably those composed of silver chlorobromide or silver chloride each containing substantially no silver iodide. The terminology "containing substantially no silver iodide" as used herein means that a silver iodide content of the emulsion is not more than 1 mol %, preferably not more than 0.2 mol %.

The halogen composition may be equal or different between individual grains in the emulsion. When an emulsion having an equal halogen composition between individual grains is used, it is easy to control the properties of the grains to be uniform. Further, with respect to distribution of halogen composition inside the silver halide emulsion grains, grains having a so-called uniform structure wherein the halogen composition is equal at any portion of the grains, grains having a so-called stratified structure wherein the halogen composition of the interior (core) of the grain is different from that of the shell (including one or more layers) surrounding the core, and grains having a structure wherein portions having different halogen compositions are present in the non-stratified form in the interior or on the surface of grains (the portion having a different composition being junctioned at an edge, corner or plane) can be appropriately selected. In order to obtain high sensitivity, it is advantageous to employ any of the two latter type grains rather than the uniform structure grains. They are also preferred in view of resistance to pressure. In the case wherein the silver halide grains have the different structures described above, the boundary of the portions having the different halogen compositions from each other may be distinct, or vague because of the formation of a mixed crystal due to the composition difference. Further, grains having an intentionally continuous change in structure may be employed.

With respect to the halogen composition of a silver chlorobromide emulsion, any silver bromide/silver chloride ratio may be employed. The ratio may be widely varied depending on the purpose, but emulsions having a silver chloride content ratio of 2% or more are preferably employed.

In photographic light-sensitive materials suitable for rapid processing, a so-called high silver chloride emulsion which has a high silver chloride content is preferably used. The silver chloride content in such a high silver chloride emulsion is preferably 90 mol % or more, more preferably 95 mol % or more.

Of such high silver chloride emulsions, those having a structure wherein a localized phase of silver bromide is present in the interior and/or on the surface of silver halide grains in the stratified form or in the non-stratified form as described above are preferred. With respect to the halogen composition of the localized phase described above, it is preferred that the silver bromide content is at least 10 mol %, and more preferably exceeding 20 mol %. The localized phase may exist in the interior of the grain, or at the edge, corner or plane of the surface of the grain. One preferred example is a grain wherein epitaxial growth is made at the corner.

On the other hand, for the purpose of minimizing the reduction in sensitivity which occurs when pressure is applied to the photographic light-sensitive material, it is also preferred to use uniform structure type grains, wherein the distribution of halogen composition is narrow in a high silver chloride emulsion having a silver chloride content of 90 mol % or more.

Further, for the purpose of reducing the amount of replenisher for a developing solution, it is effective to further increase the silver chloride content of the silver halide emulsion. In such a case, an almost pure silver chloride is used wherein the silver chloride content is from 98 mol % to 100 mol %.

The average grain size of the silver halide grains in the silver halide emulsion used in the present invention (the grain size being defined as a diameter of a circle having the same area as the projected area of the grain and being averaged by number) is preferably from 0.1 μm to 2 μm.

Moreover, it is preferred to employ a so-called monodispersed emulsion which has a grain size distribution such that the coefficient of variation (obtained by dividing the standard deviation of the grain size distribution with the average grain size) is not more than 20%, particularly not more than 15%. Further, it is preferred to employ two or more of the above described monodispersed emulsions in the same layer as a mixture or in the form of superimposed layers for the purpose of obtaining a wide latitude.

The silver halide grains contained in the photographic emulsion may have a regular crystal form such as cubic, tetradecahedral, octahedral, etc., or an irregular crystal form such as spherical, tabular, etc., or may have a composite form of these crystal forms. Also, a mixture of grains having various crystal forms may be used. Of these emulsions, those containing the grains having the above described regular crystal form in an amount of not less than 50wt %, preferably not less than 70wt %, and more preferably not less than 90wt % are advantageously used in the present invention.

Further, a silver halide emulsion wherein tabular silver halide grains having an average aspect ratio (diameter corresponding to circle/thickness) of at least 5, preferably at least 8, accounts for at least 50% of the total projected area of the silver halide grains may be preferably used in the present invention.

The silver chlorobromide emulsion used in the present invention can be prepared in any suitable manner, for example, by the methods as described in P. Glafkides, *Chemie et Physigue Photographigue,* Paul Montel (1967), G. F. Duffin, *Photographic Emulsion Chemistry,* The Focal Press (1966), and V. L. Zelikman et al., *Making and Coating Photographic Emulsion,* The Focal Press (1964). That is, any of an acid process, a neutral process, and an ammonia process can be employed.

Soluble silver salts and soluble halogen salts can be reacted by techniques such as a single jet, process, a double jet process, and a combination thereof. In addition, there can be employed a method (a so-called reversal mixing process) in which silver halide grains are formed in the presence of an excess of silver ions. As one system of the double jet process, a so-called controlled double jet process in which the pAg in a liquid phase where silver halide is formed is maintained at a predetermined level can be employed. This process gives a silver halide emulsion in which the crystal form is regular and the grain size is nearly uniform.

During the step of formation or physical ripening of silver halide grains of the silver halide emulsion used in the present invention, various kinds of multi-valent metal ion impurities can be introduced. Suitable examples of the compounds include cadmium salts, zinc salts, lead salts, copper salts, thallium salts, salts or complex salts of the element of The Group VIII of the periodic Table, for example, iron, ruthenium, rhodium palladium, osmium, iridium, and platinum. Particularly, the above described elements of Group VIII are preferably used. The amount of the compound added can be varied over a wide range depending on the purpose, but it is preferably used in an amount from $10^{-9}$ to $10^{-2}$ mol per mol of silver halide.

The silver halide emulsions used in the present invention are usually subjected to chemical sensitization and spectral sensitization.

For the chemical sensitization, a sulfur sensitization method, a representative example of which is the use of an unstable sulfur compound, a noble metal sensitization method, a representative example of which is a gold sensitization method, and a reduction sensitization method are employed individually or in a combination. The compounds preferably used in the chemical sensitization include those as described in JP-A-62-15272, page 18, right lower column to page 22, right upper column.

The spectral sensitization is performed for the purpose of imparting spectral sensitivity in the desired wavelength range to the emulsion of each layer of the photographic light-sensitive material of the present invention. According to the present invention, the spectral sensitization can be conducted by adding a spectral sensitizing dye which is a dye capable of absorbing light of a wavelength range corresponding to the desired spectral sensitivity. Suitable examples of the spectral sensitizing dyes used include those as described, for example, in F. H. Harmer, *Heterocyclic compounds-Cyanine dyes and related compounds,* John Wiley & Sons (New York, London) (1964). Specific examples of the sensitizing dyes preferably employed are described in JP-A-62-215272, page 22, right upper column to page 38.

The silver halide emulsions used in the present invention can contain various kinds of compounds or precursors thereof for preventing the occurrence of fog or for stabilizing photographic performance during the production, storage and/or photographic processing of photographic light-sensitive materials. Specific examples of the compounds preferably used are described in JP-A-62-215272, page 39 to page 72.

The silver halide emulsion used in the present invention may be a so-called surface latent image type emulsion wherein latent images are formed mainly on the surface of grains or a so-called internal latent image type emulsion wherein latent images are formed mainly in the interior of grains.

In the color photographic light-sensitive material according to the present invention, a yellow coupler, a magenta coupler and a cyan coupler which form yellow, magenta and cyan colors, respectively, upon coupling with an oxidation product of an aromatic primary amine type color developing agent can be ordinarily employed.

Cyan couplers, magenta couplers and yellow couplers which are preferably used together with the magenta coupler of formula (I) described above in the present invention include those represented by the following general formula (C-I), (C-II), (M-I) or (Y):

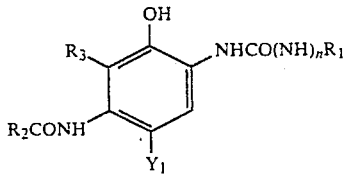

(C-I)

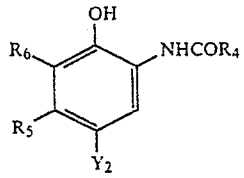

(C-II)

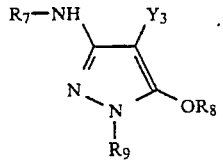

(M-I)

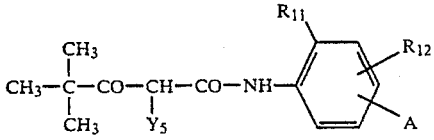

(Y)

In the general formula (C-I) or (C-II), $R_1$, $R_2$, and $R_4$ each represents a substituted or unsubstituted aliphatic, aromatic or heterocyclic group; $R_3$, $R_5$, and $R_6$ each represents a hydrogen atom, a halogen atom, an aliphatic group, an aromatic group, or an acylamino group, or $R_3$ and $R_2$ can be joined together and represent a non-metallic atomic group necessary for forming a nitrogen-containing 5-membered or 6-membered ring; $Y_1$ and $Y_2$ each represents a hydrogen atom or a group capable of being released upon a coupling reaction with an oxidation product of a developing agent; n represents 0 or 1.

$R_5$ in general formula (C-II) preferably represents an aliphatic group, for example, a methyl group, an ethyl group, a propyl group, a butyl group, a pentadecyl group, a tert-butyl group, a cyclohexyl group, a cyclohexylmethyl group, a phenylthiomethyl group, a dodecyloxyphenylthiomethyl group, a butanamidomethyl group, or a methoxymethyl group.

Preferred examples of the cyan couplers represented by the general formula (C-I) or (C-II) described above are illustrated below.

$R_1$ in general formula (C-I) preferably represents an aryl group or a heterocyclic group and more preferably an aryl group substituted with a halogen atom, an alkyl group, an alkoxy group, an aryloxy group, an acylamino group, an acyl group, a carbamoyl group, a sulfonamido group, a sulfamoyl group, a sulfonyl group, a sulfamido group, an oxycarbonyl group, or a cyano group.

When $R_3$ and $R_2$ in the general formula (C-I) do not jointly form a ring, $R_2$ preferably represents a substituted or unsubstituted alkyl or aryl group, and particularly preferably a substituted aryloxy-substituted alkyl group; and $R_3$ preferably represents a hydrogen atom.

$R_4$ in general formula (C-II) preferably represents a substituted or unsubstituted alkyl or aryl group and particularly preferably a substituted aryloxy-substituted alkyl group.

$R_5$ in general formula (C-II) preferably represents an alkyl group containing from 2 to 15 carbon atoms or a methyl group having a substituent containing 1 or more carbon atoms. As the substituent, an arylthio group, an alkylthio group, an acylamino group, an aryloxy group, and an alkyloxy group are preferable.

$R_5$ in general formula (C-II) more preferably represents an alkyl group containing from 2 to 15 carbon atoms and particularly preferably an alkyl group containing from 2 to 4 carbon atoms.

$R_6$ in general formula (C-II) preferably represents a hydrogen atom or a halogen atom and particularly preferably a chlorine atom or a fluorine atom.

$Y_1$ and $Y_2$ in general formulae (C-I) and (C-II) preferably each represents a hydrogen atom, a halogen atom, an alkoxy group, an aryloxy group, an acyloxy group, or a sulfonamido group.

In general formula (M-I), $R_7$ and $R_9$ each represents an aryl group; $R_8$ represents a hydrogen atom, an aliphatic or aromatic acyl group or an aliphatic or aromatic sulfonyl group; and $Y_3$ represents a hydrogen atom or a releasing group.

The aryl group represented by $R_7$ or $R_9$ in general formula (M-I) is preferably a phenyl group and may be substituted with one or more substituents which are selected from the substituents described for $R_1$ in formula (C-I). When two or more substituents are present, they may be the same or different. $R_8$ is preferably a hydrogen atom, an aliphatic acyl group or an aliphatic sulfonyl group, and more preferably a hydrogen atom. $Y_3$ is preferably a releasing group which is released at any of a sulfur atom, an oxygen atom or a nitrogen atom, and more preferably a releasing group of a sulfur atom releasing type as described, for example, in U.S. Pat. No. 4,351,897 and International Laid Open No. WO 88/04795.

In general formula (Y), $R_{11}$ represents a halogen atom, an alkoxy group, a trifluoromethyl group or an aryl group; $R_{12}$ represents a hydrogen atom, a halogen atom or an alkoxy group; A represents $—NHCOR_{13}$, $—NHSO_2R_{13}$, $—SO_2NHR_{13}$, $—COOR_{13}$ or $$—SO_2N(R_{14})—R_{13}$$

(wherein $R_{13}$ and $R_{14}$ each represents an alkyl group, an aryl group or an acyl group); and $Y_5$ represents a releasing group.

The group represented by $R_{12}$, $R_{13}$ or $R_{14}$ may be substituted with one or more substituents which are selected from the substituents described for $R_1$ in formula (C-I). The releasing group represented by $Y_5$ is preferably a releasing group which is released at any of an oxygen atom or a nitrogen atom, and more preferably a releasing group of a nitrogen atom releasing type.

Specific examples of the couplers represented by the general formula (C-I), (C-II), (M-I) or (Y) are set forth below, but the present invention should not be construed as being limited thereto.

(C-1)

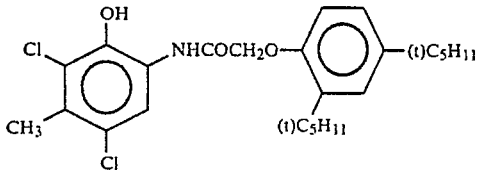

(C-2)

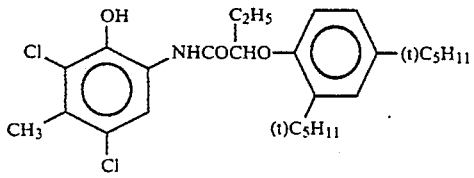

(C-3)

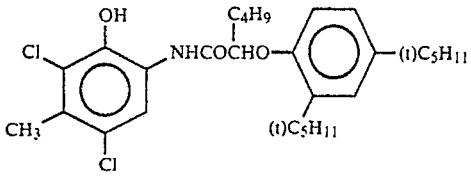

(C-4)

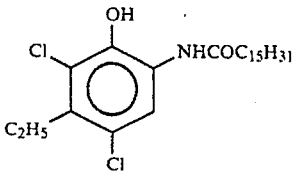

(C-5)

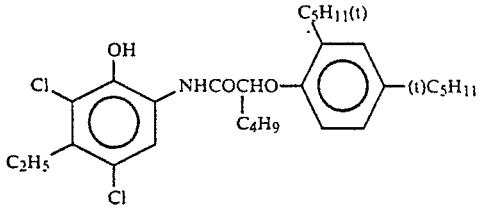

(C-6)

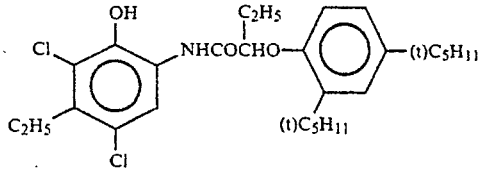

(C-7)

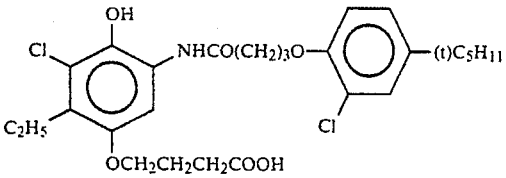

(C-8)

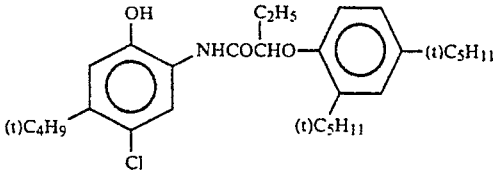

(C-9)

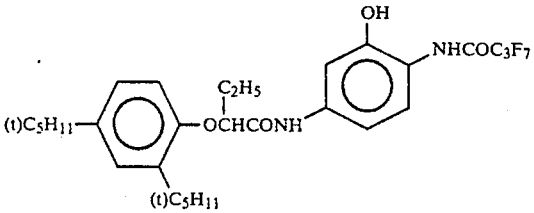

(C-10)

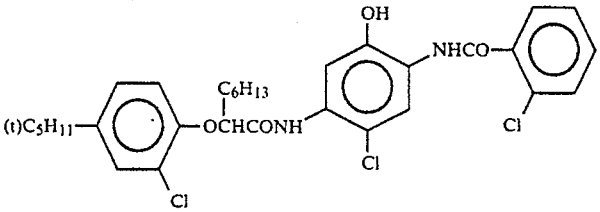

-continued
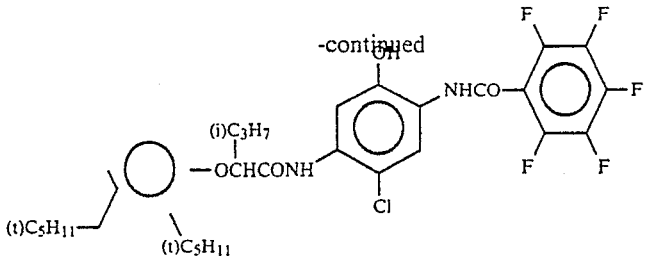
(C-11)
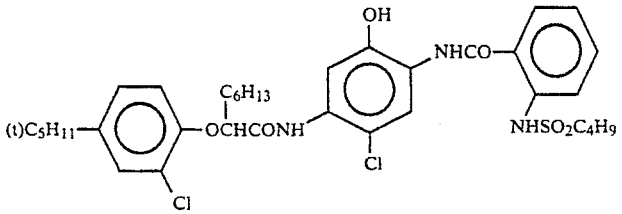
(C-12)
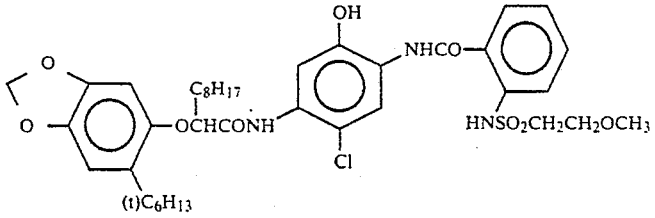
(C-13)
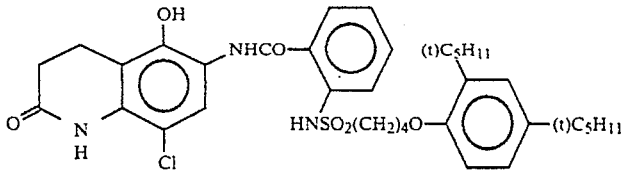
(C-14)
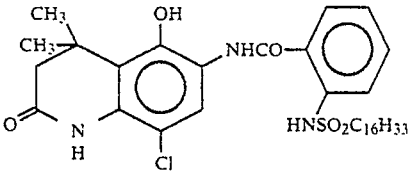
(C-15)
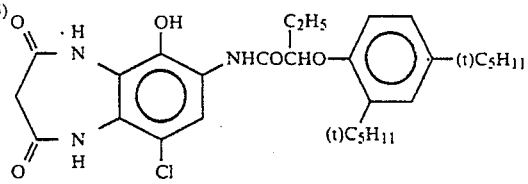
(C-16)
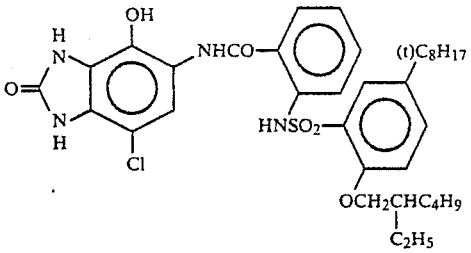
(C-17)
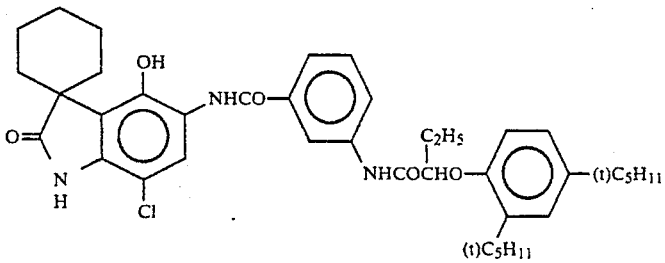
(C-18)

-continued
(C-19)
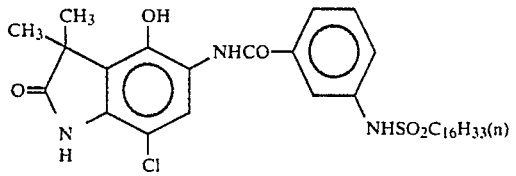
(C-20)
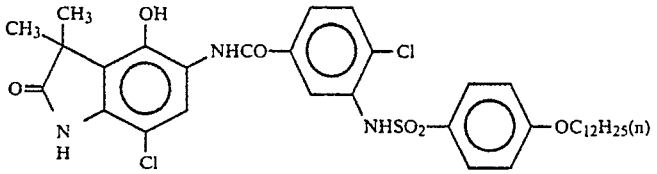
(C-21)
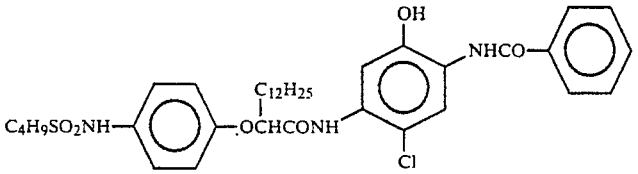
(C-22)
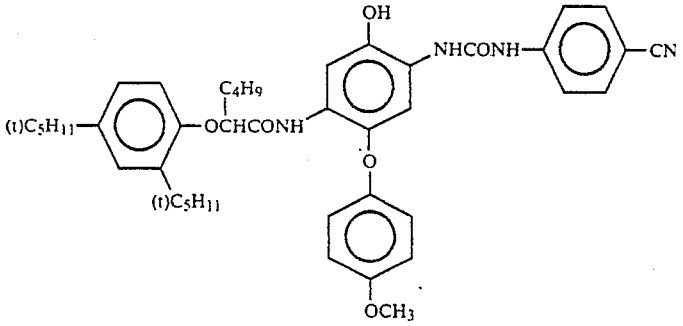
(M-1)
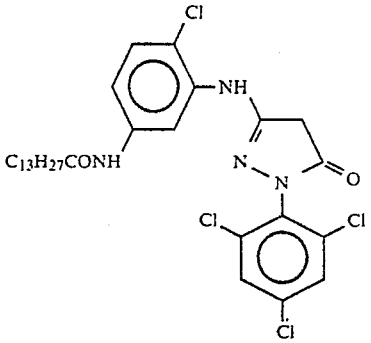
(M-2)
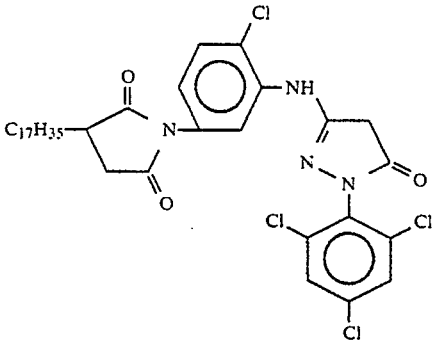
(M-3)
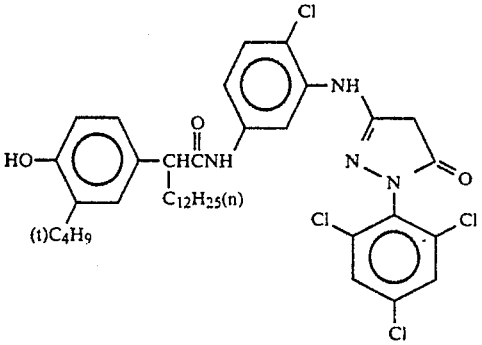
(M-4)
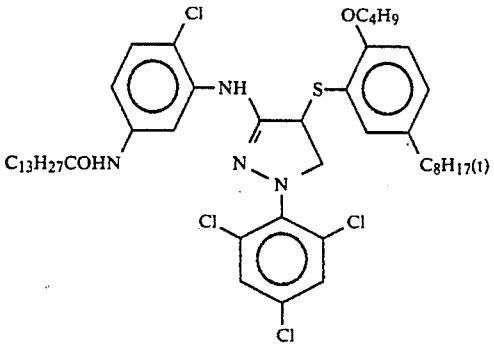

-continued
(M-5)
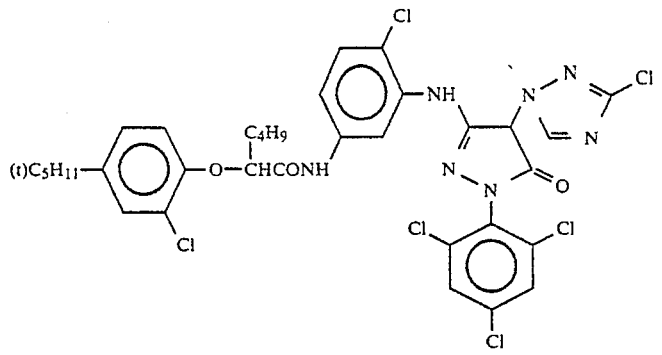
(M-6)
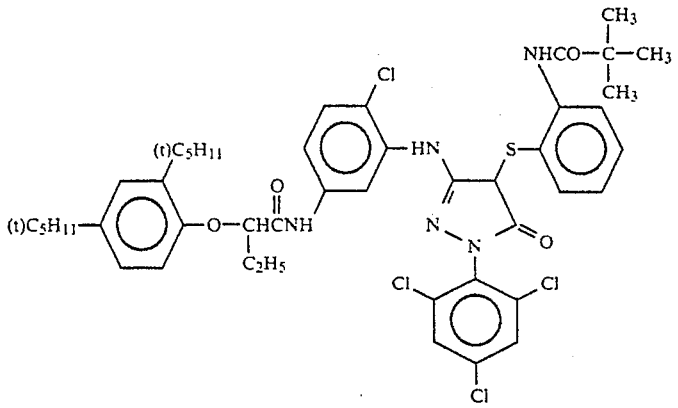
(M-7)
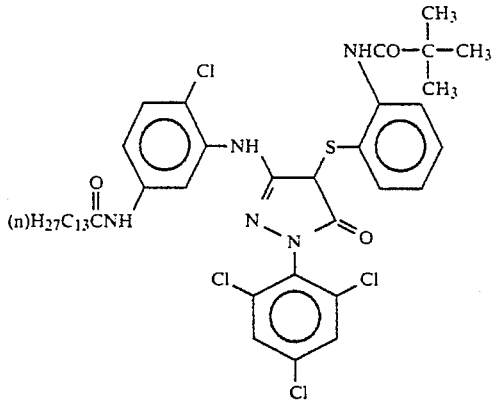
(M-8)
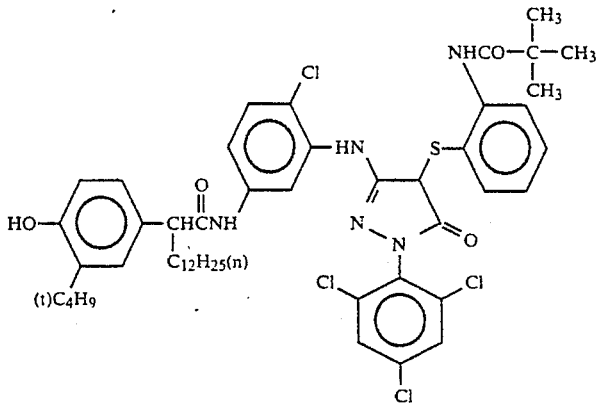

-continued
(Y-1)
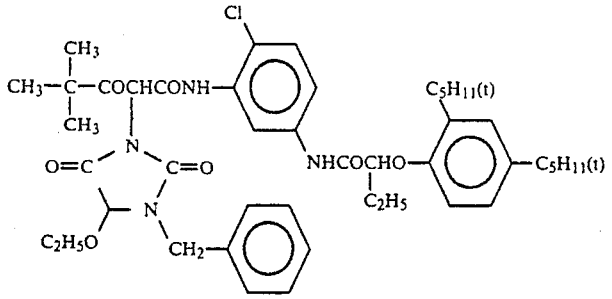
(Y-2)
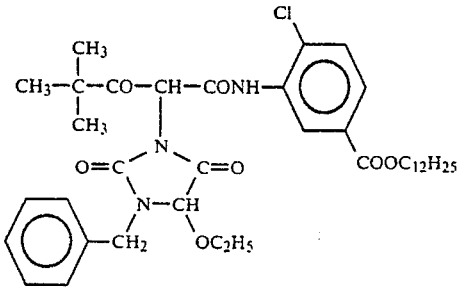
(Y-3)
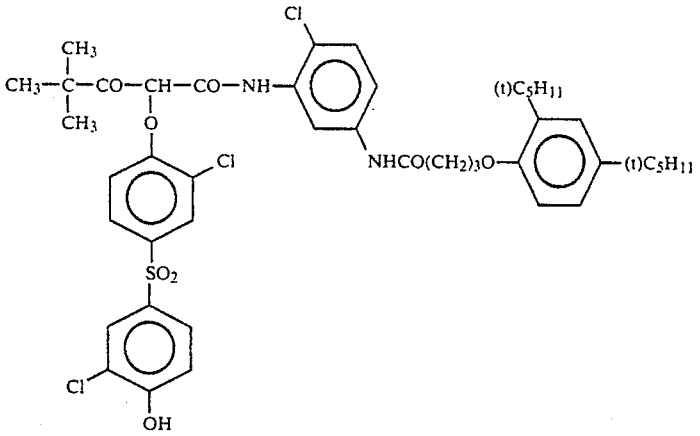
(Y-4)
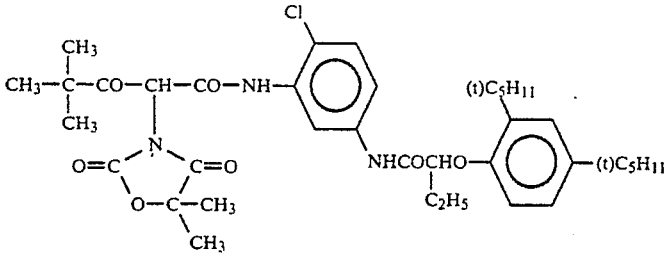
(Y-5)
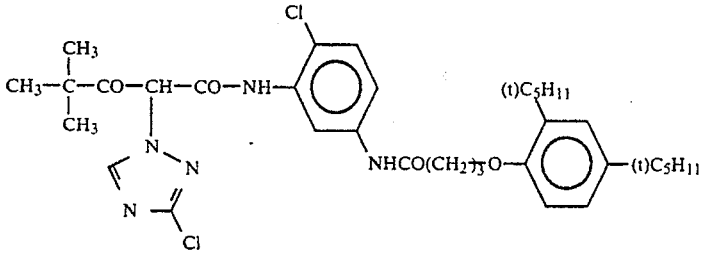

-continued (Y-6)

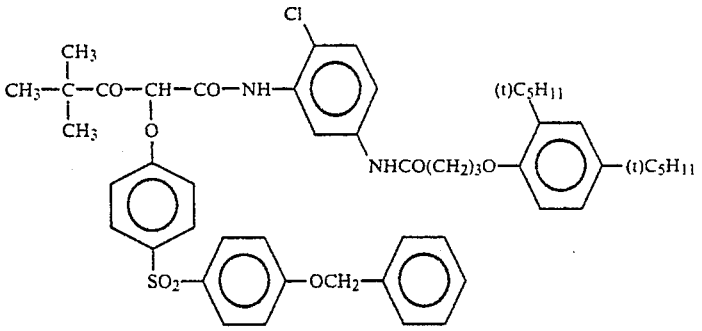

(Y-7)

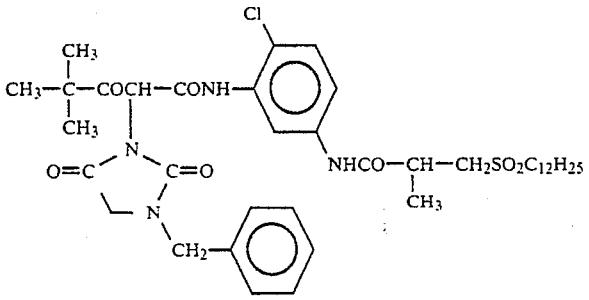

(Y-8)

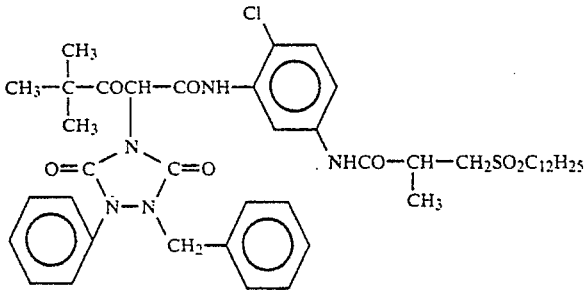

(Y-9)

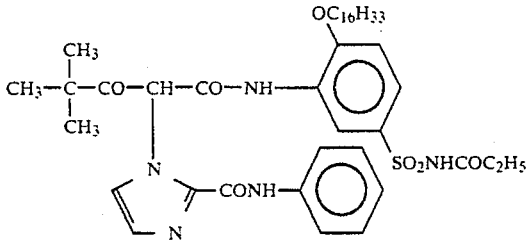

The coupler represented by the general formula (C-I), (C-II), (M-I) or (Y) described above is incorporated into a silver halide emulsion layer which constitutes a light-sensitive layer in an amount ranging generally of from 0.1 to 1.0 mole, preferably from 0.1 to 0.5 mole per mole of silver halide.

In the present invention, the above-described couplers, may be added to light-sensitive silver halide emulsion layers by applying various known techniques. Usually, they can be added according to an oil-droplet-in-water dispersion method known as an oil protected process. For example, couplers are first dissolved in a solvent, and then emulsified and dispersed in a gelatin aqueous solution containing a surface active agent. Alternatively, water or a gelatin aqueous solution may be added to a coupler solution containing a surface active agent, followed by phase inversion to obtain an oil-droplet-in-water dispersion. Further, alkali-soluble couplers may also be dispersed according to a so-called Fischer's dispersion process. The coupler dispersion may be subjected to distillation, noodle washing, ultrafiltration, or the like to remove an organic solvent having a low boiling point and then mixed with a photographic emulsion.

As the dispersion medium of the couplers, it is preferred to employ an organic solvent having a high boiling point which has a dielectric constant of 2 to 20 (at 25° C.) and a refractive index of 1.5 to 1.7 (at 25° C.) and/or a water-insoluble polymer compound.

Preferred examples of the organic solvent having a high boiling point used in the present invention include those represented by the following general formula (A), (B), (C), (D) or (E):

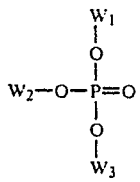

(A)

$W_1—COO—W_2$ (B)

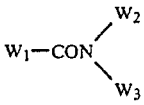

(C)

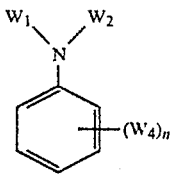

(D)

$W_1—O—W_2$ (E)

wherein $W_1$, $W_2$ and $W_3$ each represents a substituted or unsubstituted alkyl group, a substituted or unsubstituted cycloalkyl group, a substituted or unsubstituted alkenyl group, a substituted or unsubstituted aryl group or a substituted or unsubstituted heterocyclic group; $W_4$ represents $W_1$, —O—$W_1$ or —S—$W_1$; n represents an integer from 1 to 5, and when n is two or more, two or more $W_4$'s may be the same or different; $W_1$ and $W_2$ in the general formula (E) may combine with each other to form a ring.

As the organic solvent having a high boiling point which can be employed in the present invention, any compound which has a melting point of 100° C. or lower and a boiling point of 140° C. or higher and which is immiscible with water and a good solvent for the coupler may be utilized, in addition to the above described solvents represented by the general formulae (A) to (E). The melting point of the organic solvent having a high boiling point is preferably not more than 80° C. The boiling point of the organic solvent having a high boiling point is preferably not less than 160° C., more preferably not more than 170° C.

The organic solvents having a high boiling point are described in detail in JP-A-62-215272, page 137, right lower column to page 144, right upper column.

Further, these couplers can be emulsified and dispersed in an aqueous solution of a hydrophilic colloid by loading them into a loadable latex polymer (such as those described in U.S. Pat. No. 4,203,716) in the presence of or in the absence of the above described organic solvent having a high boiling point, or dissolving them in a water-insoluble and organic solvent-soluble polymer.

Suitable examples of the polymers include homopolymers and copolymers as described in International Laid Open No. WO 88/00723, pages 12 to 30. Particularly, acrylamide polymers are preferably used in view of improved color image stability.

The color photographic light-sensitive material according to the present invention may contain a hydroquinone derivative, an aminophenol derivative, a gallic acid derivative, or an ascorbic acid derivative, as a color fog preventing agent.

In the color photographic light-sensitive material according to the present invention, various color fading preventing agents can be employed. More specifically, representative examples of organic color fading preventing agents for cyan, magenta and/or yellow images include hindered phenols (for example, hydroquinones, 6-hydroxychromans, 5-hydroxycoumarans, spirochromans, p-alkoxyphenols, or bisphenols), gallic acid derivatives, methylenedioxybenzenes, aminophenols, hindered amines, or ether or ester derivatives thereof derived from each of these compounds by sililation or alkylation of the phenolic hydroxy group thereof. Further, metal complexes representatively illustrated by (bissalicylaldoxymate) nickel complex and (bis-N,N-dialkyldithiocarbamate) nickel complexes may be employed.

Specific examples of the organic color fading preventing agents are described in the following patents or patent applications.

Hydroquinones: U.S. Pat. Nos. 2,360,290, 2,418,613, 2,700,453, 2,701,197, 2,728,659, 2,732,300, 2,735,765, 3,982,944 and 4,430,425, British Patent 1,363,921, U.S. Pat. Nos. 2,710,801 and 2,816,028, etc.; 6-hydroxychromanes, 5-hydroxycoumaraus and spirochromanes: U.S. Pat. Nos. 3,432,300, 3,573,050, 3,574,627, 3,698,909 and 3,764,337, JP-A-52-152225, etc.; spiroindanes: U.S. Pat. No. 4,360,589, etc.; p-alkoxyphenols: U.S. Pat. No. 2,735,765, British Patent 2,066,975, JP-A-59-10539, JP-B-57-19765, etc.; hindered phenols: U.S. Pat. No. 3,700,455, JP-A-52-72224, U.S. Pat. No. 4,228,235, JP-B-52-6623, etc.; gallic acid derivatives, methylenedioxybenzenes and aminophenols: U.S. Pat. Nos. 3,457,079 and 4,332,886, JP-B-56-21144, etc.; hindered amines: U.S. Pat. Nos. 3,336,135 and 4,268,593, British Patents 1,326,889, 1,354,313 and 1,410,846, JP-B-51-1420, JP-A-58-114036, JP-A-59-53846, JP-A-59-78344, etc.

Further, specific examples of the metal complexes are described in U.S. Pat. Nos. 4,050,938 and 4,241,155, British Patent 2,027,731A, etc.

The color fading preventing agent is co-emulsified with the corresponding color coupler in an amount of from 5 to 100% by weight of the color coupler and incorporated into the light-sensitive layer to achieve the effects thereof.

In order to prevent degradation of the cyan dye image due to heat and particularly due to light, it is effective to introduce an ultraviolet light absorbing agent to a cyan color forming layer or to both layers adjacent to the cyan color forming layer.

Suitable examples of the ultraviolet light absorbing agents used include aryl group-substituted benzotriazole compounds (for example, those as described in U.S. Pat. No. 3,533,794), 4-thiazolidone compounds (for example, those as described in U.S. Pat. Nos. 3,314,794 and 3,352,681), benzophenone compounds (for example, those as described in JP-A-46-2784), cinnamic acid ester compounds (for example, those as described in U.S. Pat. Nos. 3,705,805 and 3,707,395), butadiene compounds (for example, those as described in U.S. Pat. No. 4,045,229), and benzoxazole compounds (for example, those as described in U.S. Pat. Nos. 3,406,070, 3,677,672 and 4,271,307). Furthermore, ultraviolet light absorptive couplers (for example, α-naphtholic cyan dye forming couplers) or ultraviolet light absorptive polymers may be used as ultraviolet light absorbing agents. These ultraviolet light absorbing agents may be mordanted in a specific layer.

Among these ultraviolet light absorbing agents, the aryl group-substituted benzotriazole compounds described above are preferred.

In accordance with the present invention, it is preferred to employ the compounds as described below together with the above described couplers, particularly pyrazoloazole couplers. More specifically, it is preferred to employ individually, or in combination, a compound (F) which is capable of forming a chemical bond with an aromatic amine developing agent remaining after color development to give a chemically inactive and substantially colorless compound and/or a compound (G) which is capable of forming a chemical bond with an oxidation product of the aromatic amine color developing agent remaining after color development to give a chemically inactive and substantially colorless compound, in order to prevent the occurrence of stain and other undesirable side-effects due to the formation of a colored dye upon a reaction of the color developing agent or oxidation product thereof which remains in the photographic layer with the coupler during preservation of the photographic material after processing.

Among the compounds (F), those capable of reacting at a second order reaction rate constant $k_2$ (in trioctyl phosphate at 80° C.) with p-anisidine of from 1.0 liter/mol·sec. to $1\times10^{-5}$ liter/mol·sec. are preferred. The second order reaction rate constant can be measured by a method as described in JP-A-63-158545.

When the constant $k_2$ is large than this range, the compounds per se are unstable and may react with gelatin or water or decompose. On the other hand, when the constant $k_2$ is smaller than the above described range, the reaction rate in the reaction with the remaining aromatic amine developing agent is low, and as a result, the degree of prevention of the side-effect due to the remaining aromatic amine developing agent, which is the object of the use, tends to be reduced.

Of the Compounds (F), those more preferred are represented by the following general formula (FI) or (FII):

$$R_1-(A)_n-X \qquad \text{(FI)}$$

$$R_2-\underset{\underset{B}{|}}{C}=Y \qquad \text{(FII)}$$

wherein $R_1$ and $R_2$ each represents an aliphatic group, an aromatic group or a heterocyclic group; n represents 0 or 1; A represents a group capable of reacting with an aromatic amine developing agent to form a chemical bond; X represents a group capable of being released upon the reaction with an aromatic amine developing agent; B represents a hydrogen atom, an aliphatic group, an aromatic group, a heterocyclic group, an acyl group or a sulfonyl group; Y represents a group capable of accelerating the addition of an aromatic amine developing agent to the compound represented by the general formula (FII); or $R_1$ and X, or Y and $R_2$ or B may combine with each other to form a cyclic structure.

Of the reactions for forming a chemical bond with the remaining aromatic amine developing agent, a substitution reaction and an addition reaction are typical reactions.

Specific preferred examples of the compounds represented by the general formulae (FI) or (FII) are described, for example, in JP-A-63-158545, JP-A-62-283338, European Patent (OPI) Nos. 298,321 and 277,589.

On the other hand, of the Compounds (G) capable of forming a chemical bond with the oxidation product of the aromatic amine developing agent remaining after color development processing to give a chemically inactive and substantially colorless compound, those more preferred are represented by the following general formula (GI):

$$R-Z \qquad \text{(GI)}$$

wherein R represents an aliphatic group, an aromatic group or a heterocyclic group; and Z represents a nucleophilic group or a group capable of being decomposed in the photographic material to release a nucleophilic group.

Of the compounds represented by the general formula (GI), those wherein Z is a group having a Pearson's nucleophilic $^{n}CH_3I$ value of at least 5 (R. G. Pearson et al., *J. Am. Chem. Soc.*, Vol. 90, page 319 (1968)) or a group derived therefrom are preferred.

Specific preferred examples of the compounds represented by the general formula (GI) are described, for example, in European Patent (OPI) No. 255,722, JP-A-62-143048, JP-A-62-229145, Japanese Patent Application Nos. 63-136724 and 62-214681, European Patent (OPI) Nos. 298,321 and 277,589.

Further, combinations of Compound (G) and Compound (F) are described in detail in European Patent (OPI) No. 277,589.

The photographic light-sensitive material according to the present invention may contain water-soluble dyes or dyes which become water-soluble at the time of photographic processing as filter dyes or for irradiation or halation prevention or other various purposes in the hydrophilic colloid layers. Examples of such dyes include oxonol dyes, hemioxonol dyes, styryl dyes, merocyanine dyes, cyanine dyes, and azo dyes. Of these dyes, oxonol dyes, hemioxonol dyes, and merocyanine dyes are especially useful.

As binders or protective colloids which can be used for the emulsion layers of the color photographic light-sensitive material according to the present invention, gelatin is advantageously used, but other hydrophilic colloids can be used alone or together with gelatin.

As gelatin, lime-treated gelatin or acid-treated gelatin can be used in the present invention. Details of the production of gelatin are described in Arther Weiss, *The Macromolecular Chemistry of Gelatin*, published by Academic Press, 1964.

As the support used in the present invention, there are those conventionally employed in photographic light-sensitive materials, for example, transparent films such as cellulose nitrate films and polyethylene terephthalate films, or reflective supports. For the purpose of the present invention, reflective supports are preferably employed.

The "reflective support" which can be employed in the present invention is a support having an increased reflection property for the purpose of rendering dye images formed in the silver halide emulsion layer clear. Examples of the reflective support include a support having coated thereon a hydrophobic resin containing a light reflective substance such as titanium oxide, zinc oxide, calcium carbonate, or calcium sulfate dispersed therein and a support composed of a hydrophobic resin containing a light reflective substance dispersed therein.

More specifically, they include baryta coated paper; polyethylene coated paper; polypropylene synthetic paper; transparent supports, for example, a glass plate, a polyester film such as a polyethylene terephthalate film, a cellulose triacetate film or a cellulose nitrate film, a polyamide film, a polycarbonate film, a polystyrene film, or a vinyl chloride resin, having a reflective layer or having incorporated therein a reflective substance.

Other examples of the reflective support which can be used are supports having a metal surface of mirror reflectivity or secondary diffuse reflectivity. The metal surface preferably has a spectral reflectance of 0.5 or more in the visible wavelength range. The metal surface are preferably produced by roughening or imparting diffusion reflectivity using metal powders. Suitable examples of metals include aluminum, tin, silver, magnesium or an alloy thereof. The metal surface includes a metal plate, a metal foil or a metal thin layer obtained by rolling, vacuum evaporation or plating. Among them, a metal surface obtained by vacuum evaporation of metal on an other substrate is preferably employed.

On the metal surface it is preferred to provide a water-proof resin layer, particularly a thermoplastic resin layer. On the opposite side of the support to the metal surface according to the present invention, an antistatic layer is preferably provided. Details of these supports are described, for example, in JP-A-61-210346, JP-A-63-24247, JP-A-63-24251 and JP-A-63-24255.

A suitable support can be appropriately selected depending on the purpose of use.

As the light reflective substance, white pigments thoroughly kneaded in the presence of a surface active agent are employed, and pigments the surface of which was treated with a divalent, trivalent or tetravalent alcohol are preferably used.

The occupied area ratio (%) per a definite unit area of fine white pigment particles can be determined in the following typical manner. Specifically, the area observed is divided into unit areas of 6 $\mu m \times 6$ $\mu m$ adjacent to each other, and the occupied area ratio (Ri) (%) of the fine particles projected on the unit areas is measured. The coefficient of variation of the occupied area ratio (%) can be obtained by a ratio of S/R wherein S is a standard deviation of Ri and R is an average value of Ri. The number (n) of the unit areas subjected to the determination is preferably 6 or more. Thus, the coefficient of variation (S/R) is obtained by the following equation:

$$\sqrt{\frac{\sum_{i=1}^{n}(Ri-R)^2}{n-1}} \Big/ \frac{\sum_{i=1}^{n} Ri}{n}$$

In the present invention, the coefficient of variation of the occupied area ratio (%) of fine pigment particles is preferably not more than 0.15, particularly preferably not more than 0.12. When the value is not more than 0.08, the dispersibility of the particles can be designated as substantially uniform.

A color developing solution which can be used in development processing of the color photographic light-sensitive material according to the present invention is an alkaline aqueous solution containing preferably an aromatic primary amine type color developing agent as a main component. As the color developing agent, while an aminophenol type compound is useful, a p-phenylenediamine compound is preferably employed. Typical examples of the p-phenylenediamine compounds include 3-methyl-4-amino-N,N-diethylaniline, 3-methyl-4-amino-N-ethyl-N-$\beta$-hydroxyethylaniline, 3-methyl-4-amino-N-ethyl-N-$\beta$-methanesulfonamidoethylaniline, 3-methyl-4-amino-N-ethyl-N-$\beta$-methoxyethylaniline, or a sulfate, hydrochloride or p-toluenesulfonate thereof.

Two or more kinds of color developing agents may be employed in a combination thereof, depending on the purpose.

The color developing solution can ordinarily contain pH buffering agents, such as carbonates or phosphates of alkali metals; and development inhibitors or anti-fogging agents such as bromides, iodides, benzimidazoles, benzothiazoles, or mercapto compounds. Further, if necessary, the color developing solution may contain various preservatives such as hydroxylamine, diethylhydroxylamine, sulfites, hydrazines, for example, N,N-biscarboxymethylhydrazine, phenylsemicarbazides, triethanolamine, or catechol sulfonic acids; organic solvents such as ethyleneglycol, or diethylene glycol; development accelerators such as benzyl alcohol, polyethylene glycol, quaternary ammonium salts, or amines; dye forming couplers; competing couplers; auxiliary developing agents such as 1-phenyl-3-pyrazolidone; viscosity imparting agents; and various chelating agents representatively illustrated by aminopolycarboxylic acids, aminopolyphosphonic acids, alkylphosphonic acids, or phosphonocarboxylic acids. Representative examples of the chelating agents include ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid, ethylenediamine-di(ohydroxyphenylacetic acid), and salts thereof.

In case of conducting reversal processing, color development is usually conducted after black-and-white development. In a black-and-white developing solution, known black-and-white developing agents, for example, dihydroxybenzenes such as hydroquinone, 3-pyrazolidones such as 1-phenyl-3-pyrazolidone, or aminophenols such as N-methyl-p-aminophenol may be employed individually or in a combination.

The pH of the color developing solution or the black-and-white developing solution is usually in a range from 9 to 12. Further, the amount of replenishment for the developing solution can be varied depending on the color photographic light-sensitive materials to be processed, but is generally not more than 3 liters per square meter of the photographic light-sensitive material. The amount of replenishment can be reduced to not more than 500 ml by decreasing the bromide ion concentration in the replenisher. In the case of reducing the amount of replenishment, it is preferred to prevent evaporation and aerial oxidation of the processing solution by means of reducing the area of the processing tank which is contact with the air.

The contact area of a photographic processing solution with the air in a processing tank can be represented by an opening rate as defined below.

$$\text{Opening Rate} = \frac{\text{Contact area of processing solution with the air (cm}^2\text{)}}{\text{Volume of processing solution (cm}^3\text{)}}$$

The opening rate described above is preferably not more than 0.1, more preferably from 0.001 to 0.05. Means for reducing the opening rate include a method using a movable cover as described in Japanese Patent Application No. 62-241342, a slit development processing method as described in JP-A-63-216050, in addition to a method wherein a shelter such as a floating cover is provided on the surface of a photographic processing solution in a processing tank.

It is preferred to apply the reduction of the opening rate not only to steps of color development and black and white development but also to all other subsequent steps, for example, bleaching, bleach-fixing, fixing, washing with water and stabilizing.

Further, the amount of replenishment can be reduced using a means which restrains accumulation of bromide ion in the developing solution.

The processing time of the color development processing is usually selected to be from 2 minutes to 5 minutes. However, it is possible to conduct reduction of the processing time by performing the color development at high temperature and high pH using a high concentration of color developing agent.

After color development, the photographic emulsion layers are usually subjected to a bleach processing. The bleach processing can be performed simultaneously with a fix processing (bleach-fix processing), or it can be performed independently from the fix processing. Further, for the purpose of a rapid processing, a processing method wherein after a bleach processing a bleach-fix processing is conducted may be employed. Moreover, processing may be appropriately practiced, depending on the purpose, by using a continuous two tank bleach-fixing bath, by carrying out fix processing before bleach-fix processing, or by conducting bleach processing after bleach-fix processing.

Examples of bleaching agents which can be employed in the bleach processing or bleach-fix processing include compounds of a multivalent metal such as iron(III). Representative examples of the bleaching agents include organic complex salts of iron(III), for example, complex salts of aminopolycarboxylic acids (such as ethylenediaminetetraacetic acid, diethylenetriaminepentaacetic acid, cyclohexanediaminetetraacetic acid, methyliminodiacetic acid, 1,3-diaminopropanetetraacetic acid, or glycol ether diaminetetraacetic acid), or complex salts of organic acids (such as citric acid, tartaric acid, or malic acid). Of these compounds, iron(III) complex salts of aminopolycarboxylic acids representatively illustrated by iron(III) complex salt of ethylenediaminetetraacetic acid are preferred in view of rapid processing and less environmental pollution. Furthermore, iron(III) complex salts of aminopolycarboxylic acids are particularly useful in both bleaching solutions and bleach-fixing solutions.

The pH of the bleaching solution or bleach-fixing solution containing an iron (III) complex salt of aminopolycarboxylic acid is usually from 4.0 to 8.0. However, for the purpose of rapid processing, it is possible to process at a pH lower than the above described range.

In the bleaching solution, the bleach-fixing solution or a prebath thereof, a bleach accelerating agent can be used, if desired. Specific examples of suitable bleach accelerating agents include compounds having a mercapto group or a disulfide bond as described, for example, in U.S. Pat. No. 3,893,858, West German Patent 1,290,812, JP-A-53-95630, and *Research Disclosure*, No. 17129 (July 1978); thiazolidine derivatives as described, for example, in JP-A-50-140129; thiourea derivatives as described, for example, in U.S. Pat. No. 3,706,561; iodides as described, for example, in JP-A-58-16235; polyoxyethylene compounds as described, for example, in West German Patent 2,748,430; polyamine compounds as described, for example, in JP-B-45-8836; and bromide ions. Of these compounds, the compounds having a mercapto group or a disulfide bond are preferred in view of their large bleach accelerating effects. Particularly, the compounds as described in U.S. Pat. No. 3,893,858, West German Patent 1,290,812 and JP-A-53-95630 are preferred. Further, the compounds as described in U.S. Pat. No. 4,552,834 are also preferred. These bleach accelerating agents may be incorporated into the color photographic light-sensitive material. These bleach accelerating agents are particularly effectively employed when color photographic light sensitive materials for photographing are subjected to bleach-fix processing.

As fixing agents which can be employed in the fixing solution or bleach-fixing solution, thiosulfates, thiocyanate, thioether compounds, thioureas, or a large amount of iodide are exemplified. Of these compounds, thiosulfates are generally employed. Particularly, ammonium thiosulfate is most widely employed. It is preferred to use sulfites, bisulfites, sulfinic acids such as p-toluenesulfinic acid, or carbonylbisulfite adducts as preservatives in the bleach-fixing solution.

After a desilvering step, the silver halide color photographic material according to the present invention is generally subjected to a water washing step and/or a stabilizing step.

The amount of water required for the water washing step may be set in a wide range depending on the characteristics of the photographic light-sensitive materials (due to elements used therein, for example, couplers, etc.), uses thereof, temperature of washing water, the number of water washing tanks (stages), the replenishment system such as countercurrent or co-current, or other various conditions. The relationship between the number of water washing tanks and the amount of water in a multi-stage countercurrent system can be determined based on the method as described in *Journal of the Society of Motion Picture and Television Engineers*, Vol. 64, pages 248 to 253 (May, 1955).

According to the multi-stage countercurrent system described in the above literature, the amount of water for washing can be significantly reduced. However, there is an increase in the staying time of the water in the tank which causes propagation of bacteria and some problems such as adhesion of floatage formed on the photographic materials occur. In the method of processing the silver halide color photographic material according to the present invention, a method for reducing the amounts of calcium ions and magnesium ions as described in JP-A-62-288838 can be particularly effectively employed in order to solve such problems. Further, sterilizers, for example, isothiazolone compounds as described in JP-A-57-8542, cyabendazoles, chlorine type sterilizers such as sodium chloroisocyanurate, benzotriazoles, sterilizers as described in Hiroshi Horiguchi, *Bokin-Bobai No Kagaku* (Sankyo Shuppan, 1986), *Biseibutsu No Mekkin-, Sakkin-, Bobai-Gijutsu,* edited by Eiseigijutsu Kai (Kogyogijutsu Kai, 1982), and *Bokin-Bobaizai Jiten,* edited by Nippon Bokin-Bobai Gakkai can be employed.

The pH of the washing water used in the processing of the photographic light-sensitive materials according to the present invention is usually from 4 to 9, preferably from 5 to 8. The temperature of the washing water and the time period for the water washing step can be variously set depending on the characteristics or uses of the photographic light-sensitive materials. However, it is general to select a temperature of from 15° C. to 45° C. and a time period from 20 sec. to 10 min. and preferably a temperature of from 25° C. to 40° C. and a time period from 30 sec. to 5 min.

The photographic light-sensitive material of the present invention can also be directly processed with a stabilizing solution in place of the above-described water washing step. In such a stabilizing process, any of the known methods as described, for example, in JP-A-57-8543, JP-A-58-14834 and JP-A-60-220345 can be employed.

Further, it is possible to conduct the stabilizing process subsequent to the above-described water washing process. One example thereof is a stabilizing bath containing formalin and a surface active agent, which is employed as a final bath in the processing of color photographic light-sensitive materials for photographing. To such a stabilizing bath, various chelating agents and antimolds may also be added.

Overflow solutions resulted from replenishment for the above-described washing water and/or stabilizing solution may be reused in other steps such as a desilvering step.

For the purpose of simplification and acceleration of processing, a color developing agent may be incorporated into the silver halide color photographic material according to the present invention. In order to incorporate the color developing agent, it is preferred to employ various precursors of color developing agents. Suitable examples of the precursors of developing agents include indoaniline type compounds as described in U.S. Pat. No. 3,342,597, Schiff's base type compounds as described in U.S. Pat. No. 3,342,599 and *Research Disclosure,* No. 14850 and ibid., No. 15159, aldol compounds as described in *Research Disclosure,* No. 13924, metal salt complexes as described in U.S. Pat. No. 3,719,492, and urethane type compounds as described in JP-A-53-135628.

Further, the silver halide color photographic material according to the present invention may contain, if desired, various 1-phenyl-3-pyrazolidones for the purpose of accelerating color development. Typical examples of the compounds include those as described, for example in JP-A-56-64339, JP-A-57-144547, and JP-A-58-115438.

In the present invention, various kinds of processing solutions can be employed at a temperature of from 10° C. to 50° C. Although a standard temperature is from 33° C. to 38° C., it is possible to carry out the processing at higher temperatures in order to accelerate the processing whereby the processing time is shortened, or at lower temperatures in order to achieve improvement in image quality and to maintain stability of the processing solutions.

Further, for the purpose of reducing the amount of silver employed in the color photographic light-sensitive material, the photographic processing may be conducted utilizing color intensification using cobalt or hydrogen peroxide as described in West German Patent 2,226,770 or U.S. Pat. No. 3,674,499.

In accordance with the present invention, color photographs are obtained which are excellent in color reproducibility and have magenta color images having highly improved light-fastness over a wide range from high density areas to low density areas.

The present invention will be explained in greater detail with reference to the following examples, but the present invention should not be construed as being limited thereto.

EXAMPLE 1

On a paper support, both surfaces of which were laminated with polyethylene, were coated layers as shown below in order to prepare a multilayer color printing paper which was designated Sample 1. The coating solutions were prepared in the following manner.

Preparation of Coating Solution for First layer 19.1 g of Yellow coupler (ExY), 4.4 g of Color image stabilizer (Cpd-1) and 1.8 g of Color image stabilizer (Cpd-7) were dissolved in a mixture of 27.2 ml of ethyl acetate and 4.1 g of Solvent (Solv-3) and 4.1 g of Solvent (Solv-6) and the resulting solution was emulsified and dispersed in 185 ml of a 10% aqueous solution of sodium dodecylbenzénesulfonate. Separately, a silver chlorobromide emulsion [mixture of a silver chlorobromide emulsion (silver bromide content: 80.0 mol %, cubic grain, average grain size: 0.85 μm, coefficient of variation: 0.08) and a silver chlorobromide emulsion (silver bromide content: 80.0 mol %, cubic grain, average grain size: 0.62 μm, coefficient of variation: 0.07) in a silver molar ratio of 1:3] was subjected to sulfur sensitization and thereto was added $5.0\times10^{-4}$ mol of a blue-sensitive sensitizing dye shown below per mol of silver to prepare a blue-sensitive emulsion. The above described emulsified dispersion was mixed with the blue-sensitive silver halide emulsion with the concentration of the resulting mixture being controlled to form the composition shown below, whereby the coating solution for the first layer was prepared.

Coating solutions for the second layer to the seventh layer were prepared in a similar manner as described for the coating solution for the first layer.

1-Oxy-3,5-dichloro-s-triazine sodium salt was used as a gelatin hardener in each layer.

The following spectral sensitizing dyes were employed in the emulsion layers, respectively.

Blue-Sensitive Emulsion Layer:

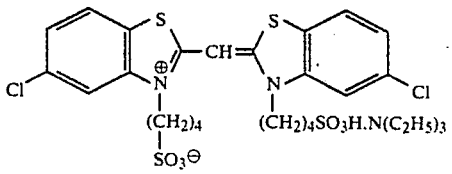

(Amount added: $5.0\times10^{-4}$ mol per mol of silver halide)

Green-Sensitive Emulsion Layer:

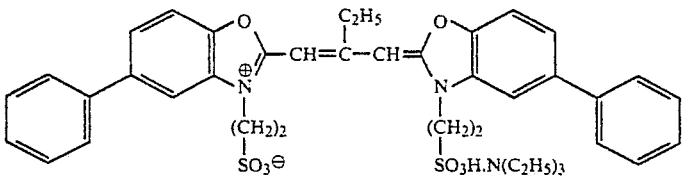

(Amount added: $4.0\times10^{-4}$ mol per mol of silver halide) and

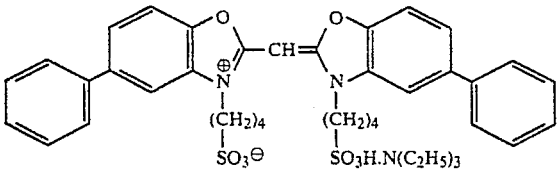

(Amount added: $7.0\times10^{-5}$ mol per mol of silver halide)

Red-Sensitive Emulsion Layer:

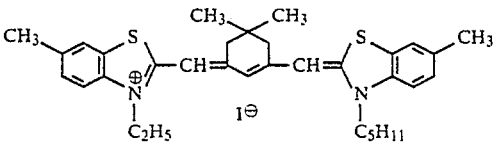

(Amount added: $0.9\times10^{-4}$ mol per mol of silver halide)

To the red-sensitive emulsion layer was added the compound described below in an amount of $2.6\times10^{-3}$ mol per mol of silver halide.

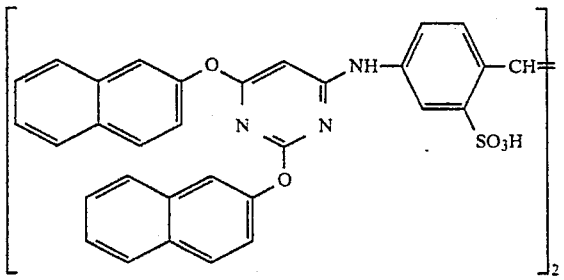

Further, to the blue-sensitive emulsion layer, green-sensitive emulsion layer and red-sensitive emulsion layer, were added 1-(5-methylureidophenyl)-5-mercaptotetrazole in amounts of $4.0\times10^{-6}$ mol, $3.0\times10^{-5}$ mol and $1.0\times10^{-5}$ mol per mol of silver halide, respectively, and 2-methyl-5-tert-octylhydroquinone in amounts of $8\times10^{-3}$ mol, $2\times10^{-2}$ mol and $2\times10^{-2}$ mol per mol of silver halide, respectively.

Moreover, to the blue-sensitive emulsion layer and green-sensitive emulsion layer, was added 4-hydroxy-6-methyl-1,3,3a,7-tetraazaindene in amounts of $1.2\times10^{-2}$ mol and $1.1\times10^{-2}$ mol per mol of silver halide, respectively.

Further, to the red-sensitive emulsion layer were added the mercaptoimidazole shown below in an amount of $2\times10^{-4}$ mol per mol of silver halide and the mercaptothiadiazole shown below in an amount of $4\times10^{-4}$ mol per mol of silver halide.

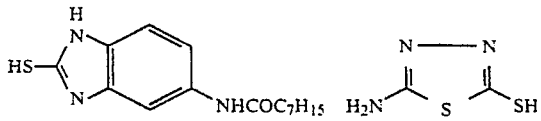

Furthermore, in order to prevent irradiation, the following dyes were added to the emulsion layers.

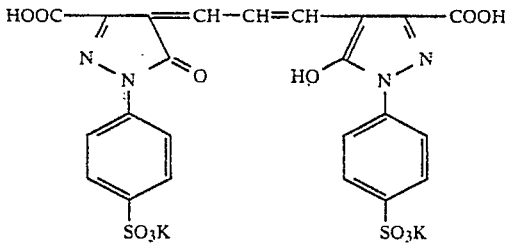

and

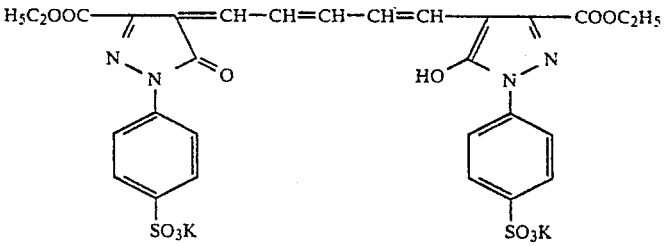

Layer Construction

The composition of each layer is shown below. The numerical values denote the coating amounts of components in the units of g/m². The coating amount of silver halide emulsion is indicated in terms of silver coating amount. Organic solvent having a high boiling point and the compound of formula (II) are incorporated into the Third layer (Green-sensitive layer).

| | | |
|---|---|---|
| Support | Polyethylene laminated paper (the polyethylene coating containing a white pigment ($TiO_2$) and a bluish dye (ultramarine) on the first layer side) | |
| First Layer (Blue-sensitive layer) | Silver chlorobromide emulsions described above (silver bromide: 80 mol %) | 0.26 |
| | Gelatin | 1.83 |
| | Yellow coupler (ExY) | 0.83 |
| | Color Image Stabilizer (Cpd-1) | 0.19 |
| | Color Image Stabilizer (Cpd-7) | 0.08 |
| | Solvent (Solv-3) | 0.18 |
| | Solvent (Solv-6) | 0.18 |
| Second Layer (Color mixing preventing layer) | Gelatin | 0.99 |
| | Color mixing preventing agent (Cpd-5) | 0.08 |
| | Solvent (Solv-1) | 0.16 |
| | Solvent (Solv-4) | 0.08 |
| Third Layer (Green-sensitive layer) | Silver chlorobromide emulsions (mixing of a silver chlorobromide emulsion (silver bromide content: 90 mol %, cubic grain, average grain size: 0.47 μm, coefficient of variation: 0.12) and a silver chlorobromide emulsion (silver bromide content: 90 mol %, cubic grain, average grain size: 0.36 μm, coefficient of variation: 0.09) in a silver molar ratio of 1:1) | 0.16 |
| | Gelatin | 1.79 |
| | Magenta coupler | Shown in Table 1 below |
| | Color image stabilizer (Cpd-2) | 0.02 |
| | Color image stabilizer (Cpd-3) | 0.20 |
| | Color image stabilizer (Cpd-4) | 0.01 |
| | Color image stabilizer (Cpd-8) | 0.03 |
| | Color image stabilizer (Cpd-9) | 0.04 |
| | Solvent | Shown in Table 1 below |
| Fourth Layer (Ultraviolet light absorbing layer) | Gelatin | 1.58 |
| | Ultraviolet light absorbing agent (UV-1) | 0.47 |
| | Color mixing preventing agent (Cpd-5) | 0.05 |
| | Color image stabilizer (Cpd-7) | 0.10 |
| | Solvent (Solv-5) | 0.24 |
| Fifth Layer (Red-sensitive layer) | Silver chlorobromide emulsions (mixing of a silver chlorobromide emulsion (silver bromide content: 70 mol %, cubic grain, average grain size: 0.49 μm, coefficient of variation: 0.08) and a silver chlorobromide emulsion (silver bromide content: 70 mol %, cubic grain, average grain size: 0.34 μm, coefficient of variation: 0.10) in a silver molar ratio of 1:2) | 0.23 |
| | Gelatin | 1.34 |
| | Cyan coupler (ExC) | 0.30 |
| | Color image stabilizer (Cpd-6) | 0.17 |
| | Color image stabilizer (Cpd-7) | 0.40 |
| | Solvent (Solv-2) | 0.10 |
| | Solvent (Solv-6) | 0.10 |
| Sixth Layer (Ultraviolet light absorbing layer) | Gelatin | 0.53 |
| | Ultraviolet light absorbing agent (UV-1) | 0.16 |
| | Color mixing preventing agent (Cpd-5) | 0.02 |
| | Color image stabilizer (Cpd-7) | 0.05 |
| | Solvent (Solv-5) | 0.08 |
| Seventh Layer (Protective layer) | Gelatin | 1.33 |
| | Acryl-modified polyvinyl alcohol copolymer (Degree of modification: 17%) | 0.17 |
| | Liquid paraffin | 0.03 |

The compounds used in the above-described layers have the chemical structures shown below, respectively.

Color image stabilizer (Cpd-1)

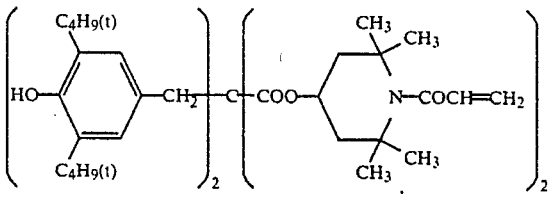

Color image stabilizer (Cpd-2)

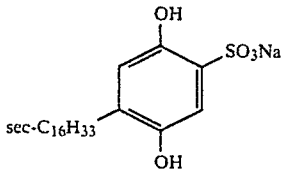

Color image stabilizer (Cpd-3)

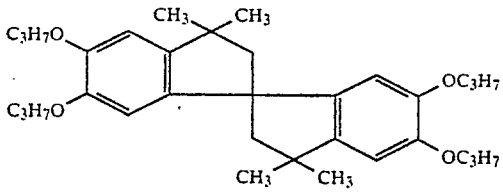

Color image stabilizer (Cpd-4)

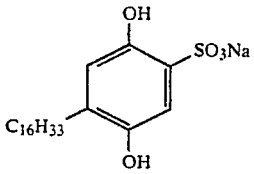

Color mixing preventing agent (Cpd-5)

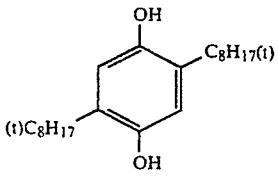

Color image stabilizer (Cpd-6)

A mixture of

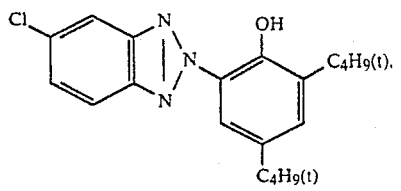
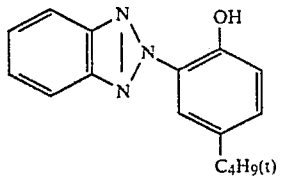
and
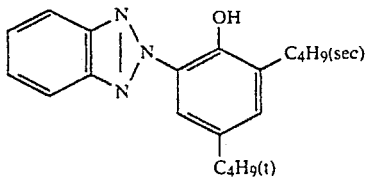
in a weight ratio of 2:4:4.
Color image stabilizer (Cpd-7)
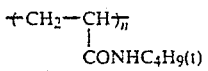
(average molecular weight: 80,000)
Color image stabilizer (Cpd-8)
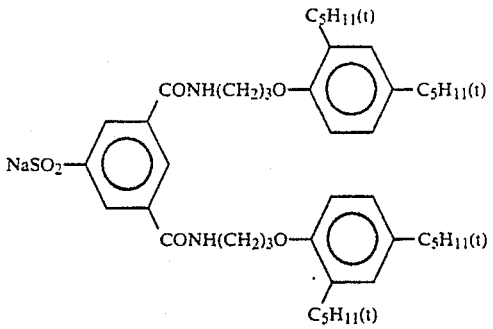
Color image stabilizer (Cpd-9)
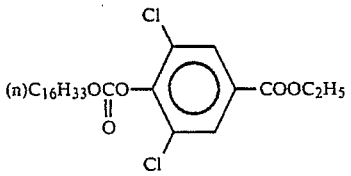
Ultraviolet light absorbing agent (UV-1)
A mixture of
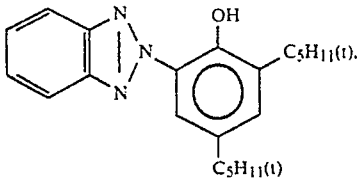
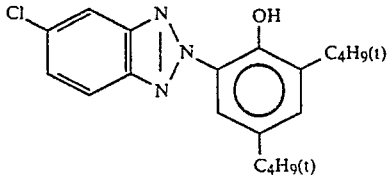
and
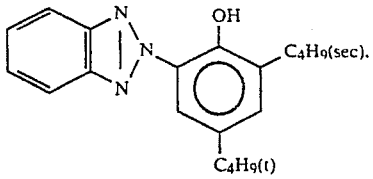
in a weight ratio of 4:2:4.
Solvent (Solv-1)
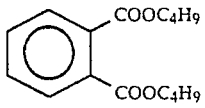
Solvent (Solv-2)
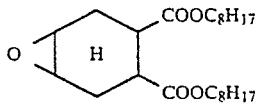
Solvent (Solv-3)
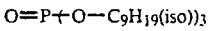
Solvent (Solv-4)
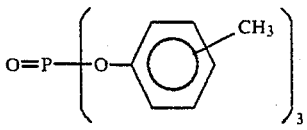
Solvent (Solv-5)
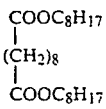
Solvent (Solv-6)

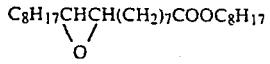

Yellow Coupler (ExY)

A mixture of

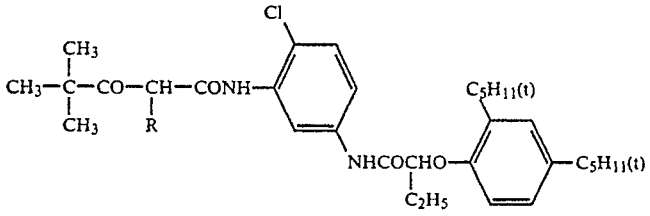

R =

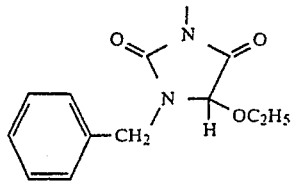

and R =

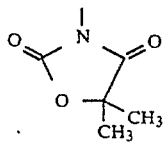

in a molar ratio of 1:1.

Cyan Coupler (ExC)

A mixture of

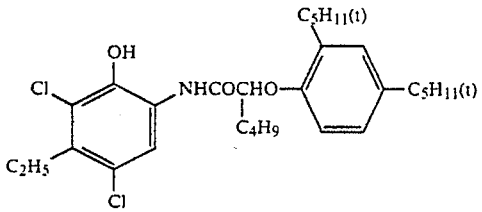

and

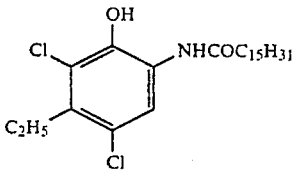

in a molar ratio of 1:1

Samples 2 to 19 were prepared in the same manner as described for Sample 1 above except for using the compounds shown in Table 1 below.

Each of these samples thus prepared was stepwise exposed through a three color separation filter for sensitometry using a sensitometer (FWH type manufactured by Fuji Photo Film Co., Ltd., color temperature of light source: 3200° K.). The amount of exposure was 250 CMS for 0.1 second.

The exposed samples were subjected to development processing according to the processing steps described below using an automatic developing machine.

| Processing Step | Temperature (°C.) | Time |
|---|---|---|
| Color Development | 37 | 3 min. 30 sec. |
| Bleach-Fixing | 33 | 1 min. 30 sec |
| Washing with Water | 24 to 34 | 3 min. |

-continued

| Processing Step | Temperature (°C.) | Time |
|---|---|---|
| Drying | 70 to 80 | 1 min. |

The composition of each processing solution used was as follows:

| Color Developing Solution: | |
|---|---|
| Water | 800 ml |
| Diethylenetriaminepentaacetic acid | 1.0 g |
| Nitrilotriacetic acid | 2.0 g |
| Benzyl alcohol | 15 ml |
| Diethylene glycol | 10 ml |
| Sodium sulfite | 2.0 g |
| Potassium bromide | 1.0 g |
| Potassium carbonate | 30 g |
| N-Ethyl-N-(β-methanesulfonamidoethyl)-3-methyl-4-aminoaniline sulfate | 4.5 g |
| Hydroxylamine sulfate | 3.0 g |
| Fluorescent brightening agent (WHITEX 4B manufactured by Sumitomo Chemical Co., Ltd.) | 1.0 g |
| Water to make | 1000 ml |
| pH (25° C.) | 10.25 |

| Bleach-Fixing Solution: | |
|---|---|
| Water | 400 ml |
| Ammonium thiosulfate (70% aqueous solution) | 150 ml |
| Sodium sulfite | 18 g |
| Ammonium iron (III) ethylenediamine-tetraacetate | 55 g |
| Disodium ethylenediamine-tetraacetate | 5 g |
| Water to make | 1000 ml |
| pH (25° C.) | 6.70 |

Test of Light-Fastness

Each of these samples thus-processed was exposed to the sun light for 35 days using an under glass outdoor irradiation equipment. Green light densities of the samples were measured before and after the sun light exposure.

Degree of fading (fading ratio) due to the sun light in high density areas and low density areas were determined in the following manner.

High Density Area: Area having an optical reflective density of 2.0 before the sun light exposure $$\text{Fading Ratio} = \frac{2.0 - D}{2.0} \times 100\%$$

Low Density Area: Area having an optical reflective density of 0.50 before the sun light exposure $$\text{Fading Ratio} = \frac{0.50 - 0.12 - D}{0.50 - 0.12} \times 100\%$$

D=Optical reflective density after the sun light exposure 0.12=Optical reflective density at the unexposed area before the sun light exposure The results obtained are shown in Table 1.

exhibit excellent light-fastness in a good balance ranging from high density areas to low density areas.

Comparative Magenta Coupler (A)

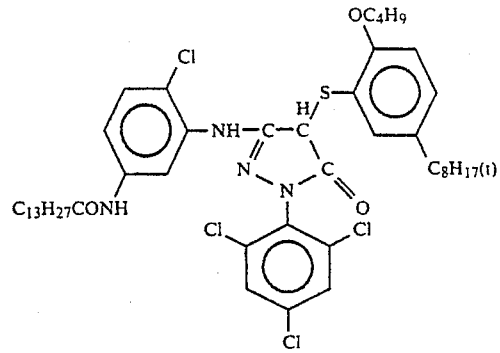

TABLE 1

| Sample No. | Magenta Coupler | Organic Solvent Having a High Boiling Point | Compound of Formula (II) or Comparative Compound | Light-Fastness in Low Density Areas (Fading Ratio) (%) |
|---|---|---|---|---|
| 1 (Comparison) | Comparative Magenta Coupler (A) | Comparative Organic Solvent (T-1) | — | 75 |
| 2 (Comparison) | Comparative Magenta Coupler (A) | S-24 | — | 70 |
| 3 (Comparison) | Comparative Magenta Coupler (A) | S-24 | II-7 | 58 |
| 4 (Comparison) | I-2 | Comparative Organic Solvent (T-1) | — | 73 |
| 5 (Comparison) | I-2 | Comparative Organic Solvent (T-1) | Comparative Color Image Stabilizer (W-1) | 73 |
| 6 (Comparison) | I-2 | Comparative Organic Solvent (T-1) | II-7 | 50 |
| 7 (Comparison) | I-2 | S-14 | — | 56 |
| 8 (Comparison) | I-2 | S-14 | Comparative Color Image Stabilizer (W-1) | 50 |
| 9 (Present Invention) | I-2 | S-14 | II-7 | 21 |
| 10 (Comparison) | I-7 | Comparative Organic Solvent (T-2) | — | 69 |
| 11 (Comparison) | I-7 | S-24 | — | 50 |
| 12 (Comparison) | I-7 | S-24 | Comparative Image Stabilizer (W-2) | 52 |
| 13 (Present Invention) | I-7 | S-24 | II-7 | 18 |
| 14 (Comparison) | I-1 | Comparative Organic Solvent (T-3) | II-16 | 58 |
| 15 (Present Invention) | I-1 | S-17 | II-16 | 25 |
| 16 (Comparison) | I-12 | Comparative Solvent (T-4) | II-17 | 51 |
| 17 (Present Invention) | I-12 | S-25 | II-17 | 19 |
| 18 (Present Invention) | I-4 | S-32 | II-15 | 21 |
| 19 (Present Invention) | I-6 | S-24 | II-18 | 26 |

*1 The amount of the organic solvent having a high boiling point added was twice the magenta coupler by weight. The amount of the compound of the formula (II) or comparative color image stabilizer added was 0.1 mol per mol of the magenta coupler.
*2 The coating amount of the magenta coupler was $3.5 \times 10^{-4}$ mol per $m^2$.
*3 The light-fastness in high density areas was from 18 to 24% in all samples.

As is apparent from the results shown in Table 1 above, the samples according to the present invention have remarkably improved light-fastness in low density areas as compared with the comparative samples, and Comparative Organic Solvent (T-1)

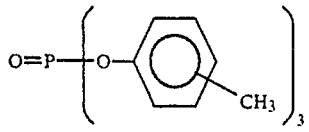

Comparative Organic Solvent (T-2)

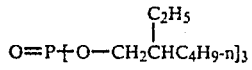

Comparative Organic Solvent (T-3)

Comparative Organic Solvent (T-4)

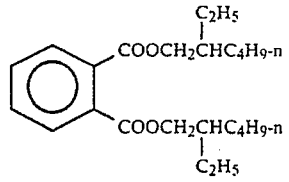

Comparative Organic Solvent (T-7)

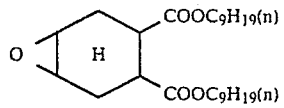

Comparative Organic Solvent (T-8)

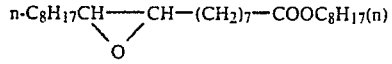

Comparative Color Image Stabilizer (W-1)

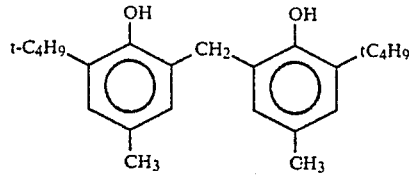

Comparative Color Image Stabilizer (W-2)

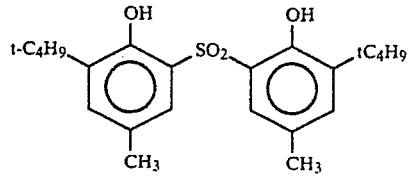

EXAMPLE 2

On a paper support, both surfaces of which were laminated with polyethylene, were coated layers as shown below in order to prepare a multilayer color printing paper which was designated Sample 1. The coating solutions were prepared in the following manner.

Preparation of Coating Solution for First Layer 19.1 g of Yellow coupler (ExY), 4.4 g of Color image stabilizer (Cpd-1) and 0.7 g of Color image stabilizer (Cpd-7) were dissolved in a mixture of 27.2 ml of ethyl acetate and 8.2 g of Solvent (Solv-1) and the resulting solution was emulsified and dispersed in 185 ml of a 10% aqueous solution of gelatin containing 8 ml of a 10% aqueous solution of sodium dodecylbenzenesulfonate. Separately, to a silver chlorobromide emulsion (cubic grains, mixture of two emulsions having average grain size of 0.88 μm and 0.70 μm in 3:7 by molar ratio of silver, coefficient of variation of grain size: 0.08 and 0.10 respectively, 0.2 mol % silver bromide based on the whole of grains being localized at the surface of grains respectively) were added two blue-sensitive sensitizing dyes shown below in an amount of each $2.0\times10^{-4}$ mol per mol of silver in case of the larger grain size emulsion and in an amount of each $2.5\times10^{-4}$ mol per mol of silver in case of the smaller grain size emulsion, and the emulsion was then subjected to sulfur sensitization. The above described emulsified dispersion was mixed with the silver chlorobromide emulsion, with the concentration of the resulting mixture being controlled to form the composition shown below, whereby the coating solution for the first layer was prepared.

Coating solutions for the second layer to the seventh layer were prepared in a similar manner as described for the coating solution for the first layer.

1-Oxy-3,5-dichloro-s-triazine sodium salt was used as a gelatin hardener in each layer.

The following spectral sensitizing dyes were employed in the emulsion layers, respectively.

Blue-Sensitive Emulsion Layer:

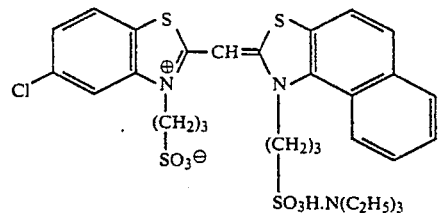

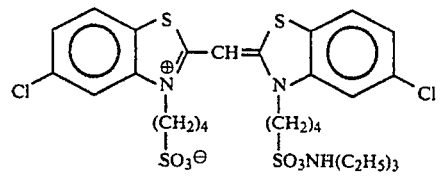

(Amount added: each $2.0\times10^{-4}$ mol per mol of silver halide in the larger grain size emulsion and each $2.5\times10^{-4}$ mol per mol of silver halide in the smaller grain size emulsion)

Green-Sensitive Emulsion Layer:

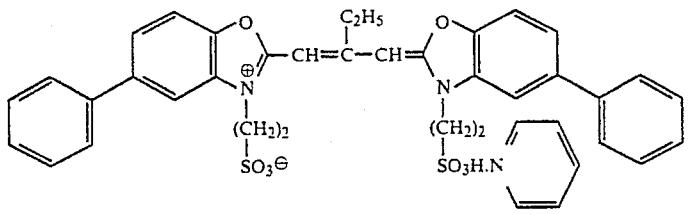

(Amount added: $4.0\times10^{-4}$ mol per mol of silver halide in the larger grain size emulsion and $5.6\times10^{-4}$ mol per mol of silver halide in the smaller grain size emulsion) and

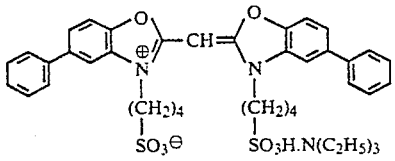

(Amount added: $7.0\times10^{-5}$ mol per mol of silver halide in the larger grain size emulsion and $1.0\times10^{-5}$ mol per mol of silver halide in the smaller grain size emulsion)

Red Sensitive Emulsion Layer:

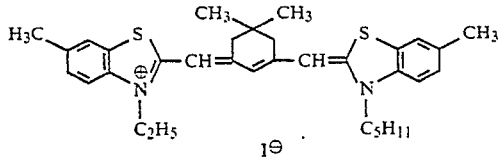

(Amount added: $0.9\times10^{-4}$ mol per mol of silver halide in the larger grain size emulsion and $1.1\times10^{-4}$ mol per mol of silver halide in the smaller grain size emulsion)

To the red-sensitive emulsion layer, was added the compound shown below in an amount of $2.6\times10^{-3}$ mol per mol of silver halide.

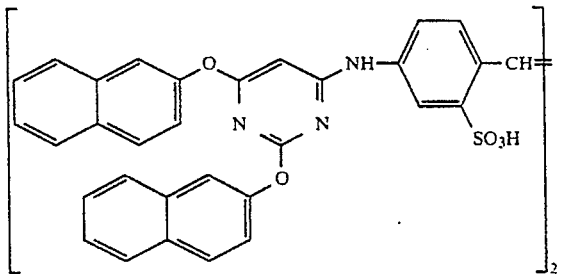

To the blue-sensitive emulsion layer, green-sensitive emulsion layer and red-sensitive emulsion layer, was added 1-(5-methylureidophenyl)-5-mercaptotetrazole in amounts of $8.5\times10^{-5}$ mol, $7.7\times10^{-4}$ mol and $2.5\times10^{-4}$ mol per mol of silver halide, respectively.

Further, to the blue-sensitive emulsion layer and green-sensitive emulsion layer was added 4-hydroxy-6-methyl-1,3,3a,7-tetraazaindene in amounts of $1\times10^{-4}$ mol and $2\times10^{-4}$ mol per mol of silver halide, respectively.

Moreover, in order to prevent irradiation, the following dyes were added to the emulsion layers.

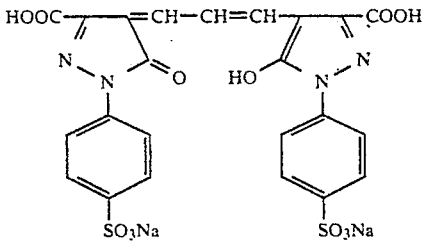

and

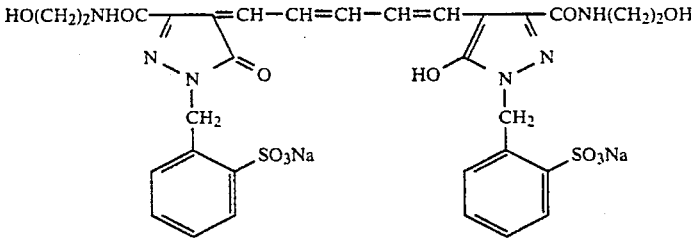

Layer Construction

The composition of each layer is shown below. The numerical values denote the coating amounts of components in the unit of g/m². The coating amount of silver halide emulsion is indicated in terms of silver coating amount. Organic solvent having a high boiling point and the compound of formula (II) are incorporated into the Third layer (Green-sensitive layer).

| | | |
|---|---|---|
| Support | Polyethylene laminated paper (the polyethylene coating containing a white pigment ($TiO_2$) and a bluish dye (ultramarine) on the first layer side) | |
| First Layer (Blue-sensitive layer) | Silver chlorobromide emulsion described above | 0.30 |
| | Gelatin | 1.86 |
| | Yellow coupler (ExY | 0.82 |
| | Color image stabilizer (Cpd-1) | 0.19 |
| | Solvent (Solv-1) | 0.35 |
| | Color image stabilizer (Cpd-7) | 0.06 |
| Second Layer (Color mixing preventing layer) | Gelatin | 0.99 |
| | Color mixing preventing agent (Cpd-5) | 0.08 |
| | Solvent (Solv-1) | 0.16 |
| | Solvent (Solv-4) | 0.08 |
| Third Layer (Green-Sensitive layer) | Silver chlorobromide emulsion (cubic grains, mixture of two emulsions having average grain size of 0.55 μm and 0.39 μm in 1:3 by molar ratio of silver, coefficient of variation of grain size: 0.10 and 0.08 respectively. 0.8 mol % silver bromide based on the whole of grains being localized at the surface of grains respectively) | 0.12 |
| | Gelatin | 1.24 |
| | Magenta coupler | Shown in Table 2 below |
| | Color image stabilizer (Cpd-2) | 0.03 |
| | Color image stabilizer (Cpd-3) | 0.15 |
| | Color image stabilizer (Cpd-4) | 0.02 |
| | Organic solvent having a high boiling point | Shown in Table 2 below |
| Fourth Layer (Ultraviolet light absorbing layer) | Gelatin | 1.58 |
| | Ultraviolet light absorbing agent (UV-1) | 0.47 |
| | Color mixing preventing agent (Cpd-5) | 0.05 |
| | Solvent (Solv-5) | 0.24 |
| Fifth Layer (Red-sensitive layer) | Silver chlorobromide emulsion (cubic grains, mixture of two emulsions having average grain size of 0.58 μm and 0.45 μm in 1:4 by molar ratio of silver, coefficient of variation of grain size: 0.09 and 0.11 respectively, 0.6 mol % silver bromide based on the whole of grains being localized at a part of the surface of grains) | 0.23 |
| | Gelatin | 1.34 |
| | Cyan coupler (ExC) | 0.32 |
| | Color image stabilizer (Cpd-6) | 0.17 |
| | Color image stabilizer (Cpd-7) | 0.40 |
| | Color image stabilizer (Cpd-8) | 0.04 |
| | Solvent (Solv-5) | 0.07 |
| | Solvent (Solv-6) | 0.08 |
| Sixth Layer (Ultraviolet light absorbing layer) | Gelatin | 0.53 |
| | Ultraviolet light absorbing agent (UV-1) | 0.16 |
| | Color mixing preventing agent (Cpd-5) | 0.02 |
| | Solvent (Solv-5) | 0.08 |
| Seventh Layer (Protective layer) | Gelatin | 1.33 |
| | Acryl-modified polyvinyl alcohol copolymer (Degree of modification: 17%) | 0.17 |
| | Liquid paraffin | 0.03 |

The compounds used in the above-described layers have the chemical structures shown below, respectively.

Yellow coupler (ExY)

A mixture of

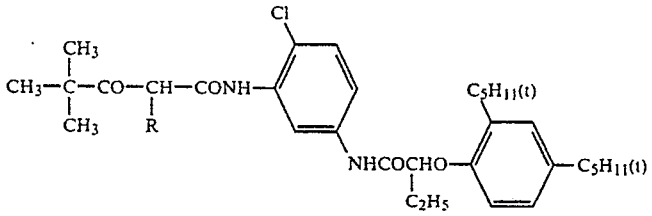

R =

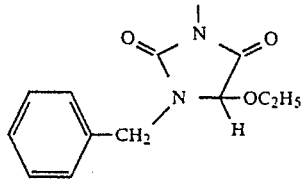

and

R =

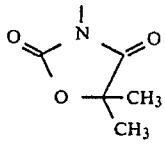

in a molar ratio of 1:1.

Cyan coupler (ExC)

A mixture of

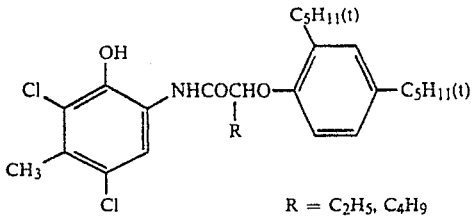
R = $C_2H_5$, $C_4H_9$
and
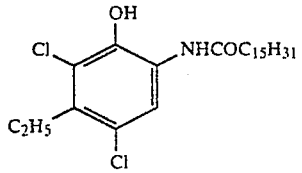
in a weight ratio of 2:4:4.
Color image stabilizer (Cpd-1)
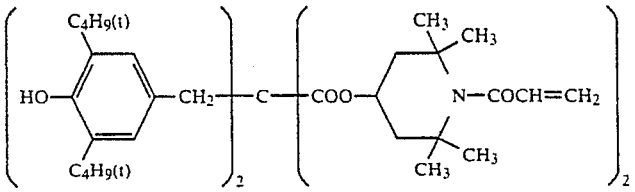
Color image stabilizer (Cpd-2)
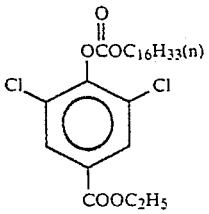
Color image stabilizer (Cpd-3)
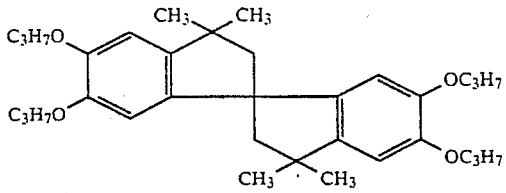
Color image stabilizer (Cpd-4)
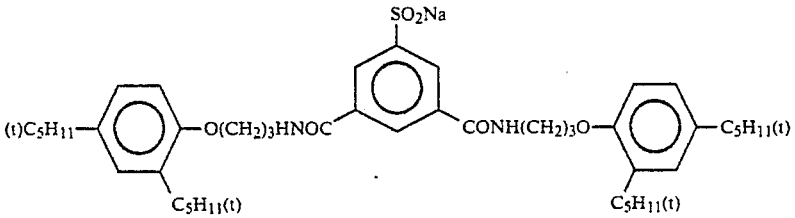
Color mixing preventing agent (Cpd-5)
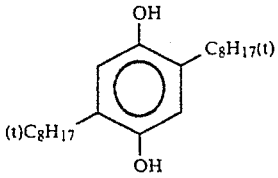
Color image stabilizer (Cpd-6)
A mixture of
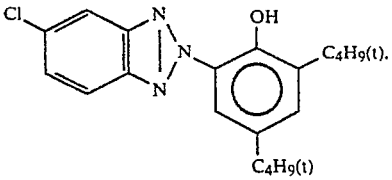
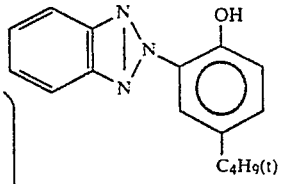
and
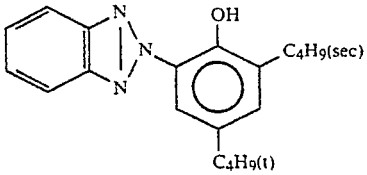
in a weight ratio of 2:4:4.
Color image stabilizer (Cpd-7)
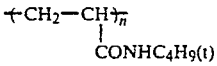
(average molecular weight: 60,000)
Color image stabilizer (Cpd-8)

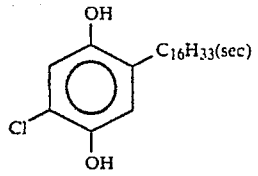

Color image stabilizer (Cpd-9)

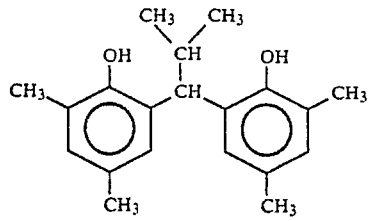

Ultraviolet light absorbing agent (UV-1)
A mixture of

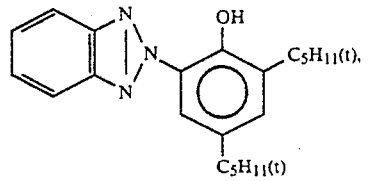

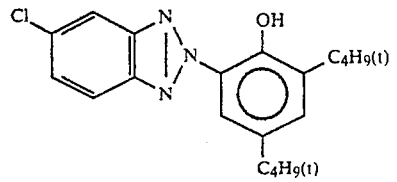

and

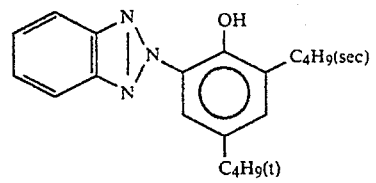

in a weight ratio of 4:2:4.
Solvent (Solv-1)

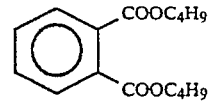

Solvent (Solv-2)

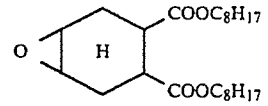

Solvent (Solv-4)

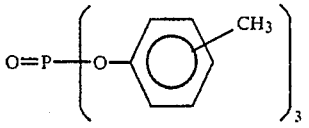

Solvent (Solv-5)

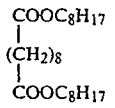

Solvent (Solv-6)

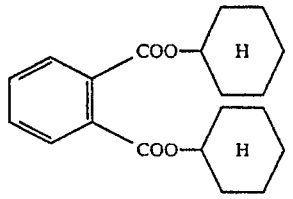

Samples 2 to 21 were prepared in the same manner as described for Sample 1 above except for using the compounds shown in Table 2 below.

Each of these samples thus prepared was exposed in the same manner as described in Example 1. The exposed samples were subjected to a continuous processing (running test) according to the processing steps shown below using a paper processor until the amount of replenisher for the color developing solution reached twice the volume of the tank for color development.

| Processing Step | Temperature (° C.) | Time (sec) | Amount of * Replenishment (ml) | Tank Capacity (l) |
|---|---|---|---|---|
| Color Development | 35 | 45 | 161 | 17 |
| Bleach-Fixing | 30-35 | 45 | 215 | 17 |
| Rinse (1) | 30-35 | 20 | — | 10 |
| Rinse (2) | 30-35 | 20 | — | 10 |
| Rinse (3) | 30-35 | 20 | 350 | 10 |
| Drying | 70-80 | 60 | | |

* The amount of replenishment per $m^2$ of photographic light-sensitive material The rinse steps were conducted using a three-tank countercurrent system from Rinse (3) to Rinse (1).

The composition of each processing solution used is illustrated below.

| Color Developing Solution: | Tank Solution | Replenisher |
|---|---|---|
| Water | 800 ml | 800 ml |
| Ethylenediamine-N,N,N,N-tetramethylenephosphonic acid | 1.5 g | 2.0 g |
| Potassium bromide | 0.015 g | — |
| Triethanolamine | 8.0 g | 12.0 g |
| Sodium chloride | 1.4 g | |
| Potassium carbonate | 25 g | 25 g |
| N-Ethyl-N-(β-methanesulfonamidoethyl)-3-methyl-4-aminoaniline sulfate | 5.0 g | 7.0 g |
| N,N-Bis(carboxymethyl)hydrazine | 5.5 g | 7.0 g |
| Fluorescent brightening agent (WHITEX 4B manufactured by Sumitomo Chemical Co., Ltd.) | 1.0 g | 2.0 g |
| Water to make | 1000 ml | 1000 ml |

-continued

| Color Developing Solution: | Tank Solution | Replenisher |
|---|---|---|
| pH (at 25° C.) | 10.05 | 10.45 |

Rinse Solution: (both tank solution and replenisher)

Ion-exchanged water (calcium and magnesium contents: not more than 3 ppm respectively)

The samples thus-processed were evaluated their light-fastness in the same manner as described in Example 1.

The results obtained are shown in Table 2.

TABLE 2

| Sample No. | Magenta Coupler | Organic Solvent Having a High Boiling Point | Compound of Formula (II) or Comparative Compound | Light-Fastness in Low Density Areas (Fading Ratio) (%) |
|---|---|---|---|---|
| 1 (Comparison) | I-5 | T-1 | W-1 | 71 |
| 2 (Comparison) | I-5 | T-1 | W-2 | 76 |
| 3 (Comparison) | I-5 | T-1 | W-3 | 73 |
| 4 (Comparison) | I-5 | T-1 | W-4 | 70 |
| 5 (Comparison) | I-5 | T-1 | II-7 | 52 |
| 6 (Comparison) | I-5 | T-1 | II-16 | 55 |
| 7 (Comparison) | I-5 | T-1 | II-18 | 48 |
| 8 (Comparison) | I-5 | T-1 | II-15 | 49 |
| 9 (Comparison) | I-5 | T-2 | II-18 | 46 |
| 10 (Comparison) | I-5 | T-3 | II-18 | 52 |
| 11 (Comparison) | I-5 | T-4 | II-18 | 58 |
| 12 (Comparison) | I-5 | T-5 | II-18 | 57 |
| 13 (Comparison) | I-5 | T-6 | II-18 | 51 |
| 14 (Present Invention) | I-5 | S-24 | II-7 | 19 |
| 15 (Present Invention) | I-5 | S-17 | II-18 | 21 |
| 16 (Present Invention) | I-5 | S-14 | II-16 | 16 |
| 17 (Present Invention) | I-5 | S-16 | II-18 | 17 |
| 18 (Present Invention) | I-5 | S-1 | II-18 | 21 |
| 19 (Present Invention) | I-5 | S-4 | II-18 | 23 |
| 20 (Present Invention) | I-5 | S-32 | II-15 | 19 |
| 21 (Present Invention) | I-7 | S-24 | II-7 | 19 |

*1 The amount of the organic solvent having a high boiling point added was twice the magenta coupler by weight. The amount of the compound of the formula (II) or comparative color image stabilizer added was 0.1 mol per mol of the magenta coupler.
*2 The coating amount of the magenta coupler was $3.7 \times 10^{-4}$ mol per $m^2$.
*3 The light-fastness test and the measurement of fading ratio in low density areas were same as those described in Example 1.

Bleach-Fixing Solution: (both tank solution and replenisher)

| | |
|---|---|
| Water | 400 ml |
| Ammonium thiosulfate (70%) | 100 ml |
| Sodium sulfite | 17 g |
| Ammonium Iron (III) ethylenediamine-tetraacetate | 55 g |
| Disodium ethylenediaminetetraacetate | 5 g |
| Ammonium bromide | 40 g |
| Water to make | 1000 ml |
| pH (at 25° C.) | 6.0 |

Comparative Organic Solvent (T-1)

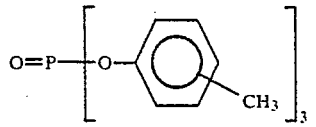

Comparative Organic Solvent (T-2)

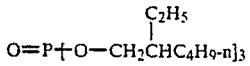

Comparative Organic Solvent (T-3)

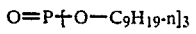

Comparative Organic Solvent (T-4)

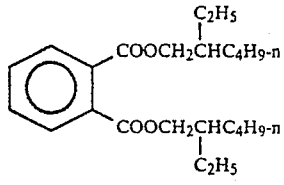

Comparative Organic Solvent (T-5)

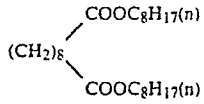

Comparative Organic Solvent (T-6)

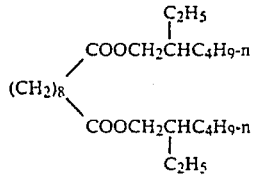

Comparative Color Image Stabilizer (W-1)

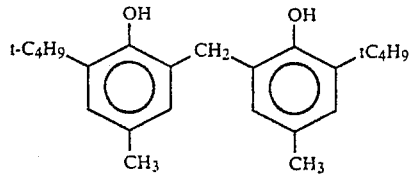

Comparative Color Image Stabilizer (W-2)

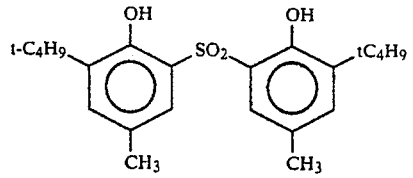

Comparative Color Image Stabilizer (W-3)

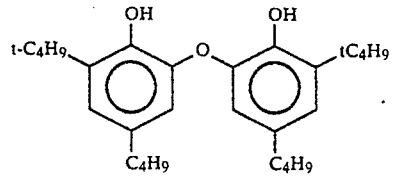

Comparative Color Image Stabilizer (W-4)

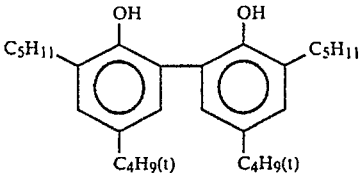

As is apparent from the results shown in Table 2, the light-fastness in low density areas is remarkably improved in Samples 14 to 21 according to the present invention. On the other hand, the comparative compounds which have similar structures to those of the compounds according to the present invention are less effective. Further, it can be seen that highly improved light-fastness can be achieved by the combination of the compounds according to the present invention.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support having thereon at least one silver halide emulsion layer, wherein at least one of the silver halide emulsion layers contains at least one magenta coupler represented by the general formula (I) described below, at least one organic solvent having a high boiling point which has at least one

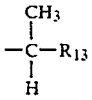

bond in its molecule, wherein $R_{13}$ represents an alkyl group, an aryl group, an alkoxy group, an aryloxy group, an alkylthio group or an arylthio group, and at least one compound represented by the general formula (II) described below:

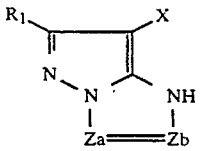

(I)

in Za and Zb each represents

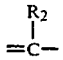

or =N—; $R_1$ and $R_2$ each represents a hydrogen atom or a substituent; X represents a hydrogen atom or a group capable of being released upon a coupling reaction with an oxidation product of an aromatic primary amine developing agent; when the Za-Zb bond is a carbon-carbon double bond, it may form a part of a condensed aromatic; and $R_1$, $R_2$ or X may form a polymer including a dimer or a higher polymer,

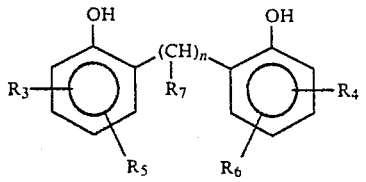

(II)

wherein $R_3$, $R_4$, $R_5$ and $R_6$ each represents an alkyl group having from 1 to 18 carbon atoms; $R_7$ represents a hydrogen atom or an alkyl group having from 1 to 12 carbon atoms; and n represents an integer of 1 to 3, with the proviso that when n is 2 or 3, the two or three groups represented by $R_7$ may be the same or different, and when n is 1, the group represented by $R_7$ is the alkyl group defined above.

2. A silver halide color photographic material as claimed in claim 1, wherein the magenta coupler is a compound represented by the following general formula (Ia) or (Ib):

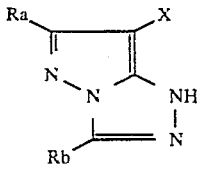

(Ia)

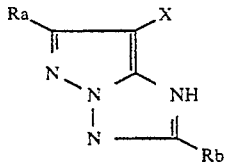

(Ib)

wherein Ra and Rb each represents a hydrogen atom or a substituent; X represents a hydrogen atom or a group capable of being released upon a coupling reaction with an oxidation product of an aromatic primary amine developing agent; and Ra, Rb or X may form a polymer including a dimer or a higher polymer.

3. A silver halide color photographic material as claimed in claim 1, wherein the substituent represented by $R_1$ or $R_2$ is a halogen atom, an alkyl group, an aryl group, a heterocyclic group, a cyano group, an alkoxy group, an aryloxy group, a heterocyclic oxy group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group or aryloxycarbonyl group.

4. A silver halide color photographic material as claimed in claim 1, wherein $R_1$ and $R_2$ each represents an alkyl group, an alkoxy group, an alkylthio group, an aryl group, an aryloxy group, an arylthio group, an acylamino group or an anilino group.

5. A silver halide color photographic material as claimed in claim 1, wherein the group capable of being released upon a coupling reaction with an oxidation product of an aromatic primary amine developing agent is a hydrogen atom, a halogen atom, a carboxy group or a group capable of being released upon coupling which is bonded to the carbon atom at the coupling position of the magenta coupler through an oxygen atom, a nitrogen atom or a sulfur atom.

6. A silver halide color photographic material as claimed in claim 1, wherein the magenta coupler is a polymer coupler obtained from a vinyl monomer having the moiety of the coupler represented by the general formula (I).

7. A silver halide color photographic material as claimed in claim 1, wherein the amount of the magenta coupler is from $1\times10^{-2}$ to 1 mol per mol of silver halide.

8. A silver halide color photographic material as claimed in claim 1, wherein the organic solvent having a high boiling point is a compound represented by the following general formula (III), (IV), (V), (VI), (VII), (VIII), (IX) or (X):

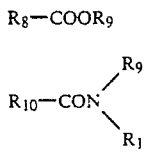

(III)

(IV)

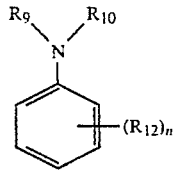

(V)

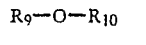

(VI)

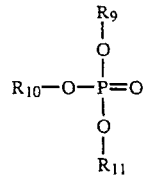

(VII)

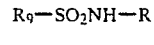

(VIII)

(IX)

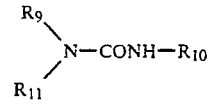

(X)

wherein $R_8$ represents a substituted or unsubstituted alkyl group, a substituted or unsubstituted cycloalkyl group, a substituted or unsubstituted alkenyl group or a substituted or unsubstituted heterocyclic group; $R_9$, $R_{10}$ and $R_{11}$ each represents a substituted or unsubstituted alkyl group, a substituted or unsubstituted cycloalkyl group, a substituted or unsubstituted alkenyl group, a substituted or unsubstituted aryl group or a substituted or unsubstituted heterocyclic group; $R_9$ and $R_{10}$ in the general formula (VI) may combine with each other to form a ring; $R_{12}$ represents $R_9$, $-OR_9$ or $-SR_9$; and n represents an integer from 1 to 5, and when n is two or more, two or more $R_{12}$'s may be the same or different, with the proviso that the organic solvent having a high boiling point represented by the general formula (III), (IV), (V), (VI), (VII), (VIII), (IX) or (X) has at least one

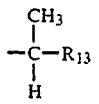

bond in the molecule thereof, wherein $R_{13}$ represents an alkyl group, an aryl group, an alkoxy group, an aryloxy group, an alkylthio group or an arylthio group, at least one of $R_8$ and $R_9$ in the general formula (III), at least one of $R_9$, $R_{10}$ and $R_{11}$ in the general formula (IV), (VII) or (X), at least one of $R_9$, $R_{10}$ and $R_{12}$ in the general formula (V), and at least one of $R_9$ and $R_{10}$ in the general formula (VI), (VIII) and (IX) has the

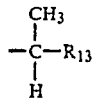

bond.

9. A silver halide color photographic material as claimed in claim 8, wherein $R_{13}$ is an alkyl group having 1 to 15 carbon atoms, an aryl group selected from the group consisting of phenyl group, naphthyl group and a substituted group thereof, an alkoxy group having 1 to 15 carbon atoms, an aryloxy group selected from the group consisting of phenoxy group, naphthoxy group and a substituted group thereof, an alkylthio group having 1 to 15 carbon atoms or an arylthio group selected from the group consisting of phenylthio group, naphthylthio group and a substituted group thereof.

10. A silver halide color photographic material as claimed in claim 8, wherein the organic solvent is a compound represented by the general formula (VI) or (VII).

11. A silver halide color photographic material as claimed in claim 1, wherein the amount of the organic solvent having a high boiling point is from 0.2 to 5 times by weight based on the amount of the magenta coupler represented by general formula (I).

12. A silver halide color photographic material as claimed in claim 1, wherein the alkyl group represented by $R_3$, $R_4$, $R_5$, $R_6$ or $R_7$ is a substituted or unsubstituted, straight chain, branched chain or cyclic alkyl group.

13. A silver halide color photographic material as claimed in claim 12, wherein the substituent for the alkyl group is a halogen atom, an alkyl group, an aryl group, a heterocyclic group, a cyano group, an alkoxy group, an aryloxy group, a heterocyclic oxy group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group or aryloxycarbonyl group.

14. A silver halide color photographic material as claimed in claim 12, wherein the total number of carbon atoms included in the groups represented by $R_3$ to $R_7$ is from 6 to 32.

15. A silver halide color photographic material as claimed in claim 12, wherein $R_7$ is an alkyl group having from 3 to 12 carbon atoms.

16. A silver halide color photographic material as claimed in claim 12, wherein $R_3$ and $R_4$ each represents a methyl group.

17. A silver halide color photographic material as claimed in claim 1, wherein the amount of the compound represented by general formula (II) is from 1 to 100 mole % based on the magenta coupler represented by general formula (I).

18. A silver halide color photographic material as claimed in claim 1, wherein the magenta coupler represented by general formula (I) and the compound represented by general formula (II) are co-emulsified with the organic solvent having a high boiling point.

19. A silver halide color photographic material as claimed in claim 1, wherein the silver halide color photographic material further contains an image stabilizer represented by the following general formula (XI):

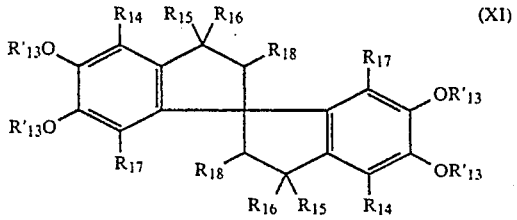

(XI)

wherein $R'_{13}$ represents an aliphatic group, an aromatic group, a heterocyclic group or a substituted silyl group represented by the formula

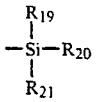

(wherein $R_{19}$, $R_{20}$ and $R_{21}$, which may be the same or different, each represents an aliphatic group, an aromatic group, an aliphatic oxy group or an aromatic oxy group) $R_{14}$, $R_{15}$, $R_{16}$, $R_{17}$ and $R_{18}$, which may be the same or different, each represents a hydrogen atom, an aliphatic group, an aromatic group, an acylamino group, a mono- or di-alkylamino group, an aliphatic or aromatic thio group, an aliphatic or aromatic oxycarbonyl group or —$OR'_{13}$.

20. A silver halide color photographic material as claimed in claim 19, wherein the amount of the image stabilizer represented by general formula (XI) is from 10 to 200 mole % based on the magenta coupler represented by general formula (I).

21. A silver halide color photographic material as claimed in claim 1, wherein the silver halide emulsion layer containing the magenta coupler is a green-sensitive silver halide emulsion layer.

22. A silver halide color photographic material as claimed in claim 1, wherein the silver halide emulsion is composed of silver chlorobromide or silver chloride each containing silver chloride content of 90 mol % or more and substantially no silver iodide.

* * * * *